US007537205B2

(12) United States Patent
Nagata et al.

(10) Patent No.: US 7,537,205 B2
(45) Date of Patent: May 26, 2009

(54) DEVICE, METHOD, AND COMPUTER PROGRAM PRODUCT FOR CONTROLLING RING BINDING

(75) Inventors: Tadashi Nagata, Kanagawa (JP); Nobuaki Tomidokoro, Kanagawa (JP); Tsuyoshi Endoh, Kanagawa (JP); Motoyuki Katsumata, Kanagawa (JP); Kohji Ishikura, Kanagawa (JP); Akira Miyazaki, Kanagawa (JP); Aritaka Hagiwara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 113 days.

(21) Appl. No.: 11/901,206

(22) Filed: Sep. 13, 2007

(65) Prior Publication Data

US 2008/0069664 A1 Mar. 20, 2008

(30) Foreign Application Priority Data

Sep. 15, 2006 (JP) ..... 2006-251080
Jul. 27, 2007 (JP) ..... 2007-196379

(51) Int. Cl.
*B65H 37/04* (2006.01)

(52) U.S. Cl. ..... 270/58.09; 270/58.07; 270/58.08

(58) Field of Classification Search ..... 270/58.07, 270/58.08, 58.09; 412/11, 33, 38, 42
See application file for complete search history.

(56) References Cited

U.S. PATENT DOCUMENTS

| | | | | |
|---|---|---|---|---|
| 5,150,998 | A * | 9/1992 | Murakami et al. | 412/14 |
| 6,000,894 | A * | 12/1999 | Suzuki et al. | 412/11 |
| 6,550,757 | B2 * | 4/2003 | Sesek | 270/58.09 |
| 6,595,509 | B2 * | 7/2003 | Sesek | 270/58.09 |
| 2008/0246205 | A1 * | 10/2008 | Fujii et al. | 270/58.08 |

FOREIGN PATENT DOCUMENTS

| | | |
|---|---|---|
| JP | 6-286931 | 10/1994 |
| JP | 2703282 | 10/1997 |
| JP | 2001-171898 | 6/2001 |
| JP | 2001-192164 | 7/2001 |
| JP | 2003-320780 | 11/2003 |
| JP | 2005-239429 | 9/2005 |

* cited by examiner

*Primary Examiner*—Gene Crawford
*Assistant Examiner*—Leslie A Nicholson, III
(74) *Attorney, Agent, or Firm*—Cooper & Dunham, LLP

(57) ABSTRACT

A size storing unit stores a size of a ring member for binding stacked sheets. A range determining unit determines whether a thickness represented by input thickness information is larger than a minimum total thickness of sheets allowed to be bound with a ring member having the stored size and equal to or smaller than a maximum total thickness of sheets that can be bound with the ring member. When it is determined that the thickness represented by the thickness information is equal to or smaller than the minimum total thickness or larger than the maximum total thickness, a setting unit sets the size stored in the size storing unit to a different size.

13 Claims, 14 Drawing Sheets

DEVICE, METHOD, AND COMPUTER PROGRAM PRODUCT FOR CONTROLLING RING BINDING

CROSS-REFERENCE TO RELATED APPLICATIONS

The present application claims priority to and incorporates by reference the entire contents of Japanese priority document, 2006-251080 filed in Japan on Sep. 15, 2006 and 2007-196379 filed in Japan on Jul. 27, 2007.

BACKGROUND OF THE INVENTION

1. Field of the Invention

The present invention relates to a technology for controlling a sheet post-processing device that automatically binds a plurality of printed sheets.

2. Description of the Related Art

Office automation (OA) equipment, such as a copier, has been proposed, which includes or is connected to a sheet post-processing device, such as a finisher. The sheet post-processing device performs an automated sheet post-processing on printed sheets, leading to effective office work. For example, a sheet post-processing device disclosed in Japanese Patent Application Laid-open No. H06-286931 is configured to bind sheets by stapling and gluing. Japanese Patent Application Laid-open No. 2005-239429 discloses a sheet post-processing device, i.e., a ring binding device, configured to punch sheets and bind the sheets with a ring member. Unlike the stapling and the gluing, the ring binding device described above is advantageous because the sheets bound with the ring member can be taken from the ring by simply opening the ring.

Because the volume (number) of printed sheets to be bound varies, it is desirable that printed sheets be bound with a ring member having an appropriate size corresponding to a total thickness of the sheets. For example, if 10 sheets are bound with a 100-sheet ring member, with which 100 sheets can be bound at maximum, the ring member is too large for the sheets and unnecessarily requires a space. On the other hand, if 50 sheets are bound with a 50-sheet ring member, with which 50 sheets can be bound at maximum, each sheet can hardly be turned over with ease. The maximum volume of sheets to be bound with a ring depends on the size of the ring (i.e., the diameter of the rings). If a thickness of each sheet is uniform, the total thickness of sheets is proportional to the volume of sheets. Therefore, on the condition that every sheet to be bound has the same thickness, the maximum volume of sheets to be bound corresponds to a maximum total thickness of the sheets.

However, according to Japanese Patent Application Laid-open No. 2005-239429, because the ring binding device employs a ring member of one size, sheets cannot be bound with the ring member having a size suitable for the total thickness of sheets.

SUMMARY OF THE INVENTION

It is an object of the present invention to at least partially solve the problems in the conventional technology.

A ring-binding control device according to one aspect of the present invention includes a thickness input unit that inputs thickness information representing a total thickness of sheets stacked on a predetermined stacking unit; a size storing unit that stores therein a size of a ring member for binding the sheets; a range determining unit that determines whether the thickness represented by the thickness information is larger than a minimum total thickness of sheets that are allowed to be bound with a ring member having the size stored in the size storing unit and equal to or smaller than a maximum total thickness of sheets that can be bound with the ring member; a setting unit that sets, when it is determined that the thickness represented by the thickness information is equal to or smaller than the minimum total thickness or larger than the maximum total thickness, the size stored in the size storing unit to a different size; and an instructing unit that issues an instruction for binding the sheets stacked on the stacking unit with a ring member having the size stored in the size storing unit.

A method of controlling a ring binding, according to another aspect of the present invention, includes inputting thickness information representing a total thickness of sheets stacked on a predetermined stacking unit; storing a size of a ring member for binding the sheets; determining whether the thickness represented by the thickness information is larger than a minimum total thickness of sheets that are allowed to be bound with a ring member having the size stored at the storing and equal to or smaller than a maximum total thickness of sheets that can be bound with the ring member; setting, when it is determined that the thickness represented by the thickness information is equal to or smaller than the minimum total thickness or larger than the maximum total thickness, the size stored at the storing to a different size; and issuing an instruction for binding the sheets stacked on the stacking unit with a ring member having the size stored at the storing.

A computer program product according to still another aspect of the present invention includes a computer-usable medium having computer-readable program codes embodied in the medium that when executed cause a computer to execute inputting thickness information representing a total thickness of sheets stacked on a predetermined stacking unit; storing a size of a ring member for binding the sheets; determining whether the thickness represented by the thickness information is larger than a minimum total thickness of sheets that are allowed to be bound with a ring member having the size stored at the storing and equal to or smaller than a maximum total thickness of sheets that can be bound with the ring member; setting, when it is determined that the thickness represented by the thickness information is equal to or smaller than the minimum total thickness or larger than the maximum total thickness, the size stored at the storing to a different size; and issuing an instruction for binding the sheets stacked on the stacking unit with a ring member having the size stored at the storing.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
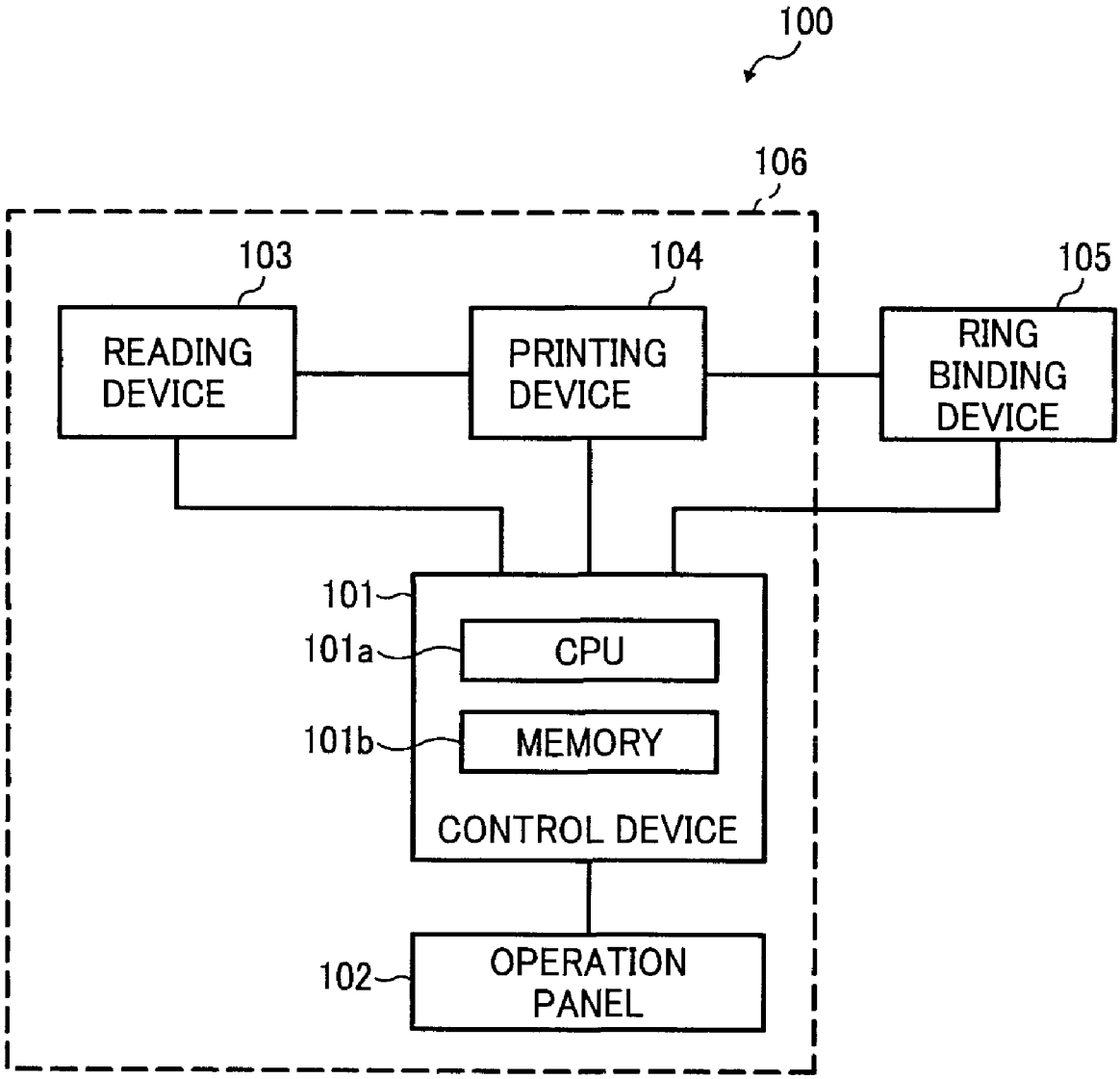
FIG. 1 is a block diagram of an image forming apparatus according to a first embodiment of the present invention.

FIG. 1 is a block diagram of an image forming apparatus 100 according to an embodiment of the present invention. The image forming apparatus 100 includes a ring binding device 105 and a copier 106. The copier 106 includes a control device 101 that controls the image forming apparatus 100, an operation panel 102 that is connected to the control device 101, a reading device 103, and a printing device 104. The reading device 103, the ring binding device 105, and the printing device 104 are controlled by the control device 101.

The operation panel 102 includes various keys for operating the image forming apparatus 100. By operating the operation panel 102, an operator can operate the devices explained below.

The reading device 103 optically reads an image on an original sheet placed on an auto document feeder (ADF) or a glass platen and generates electric signals (i.e., image data).

The printing device 104 performs print processing on the image data generated by the reading device 103.

The ring binding device 105 stores sheets discharged from the copier 106 and performs sheet post-processing on the sheets.

Figure 2:
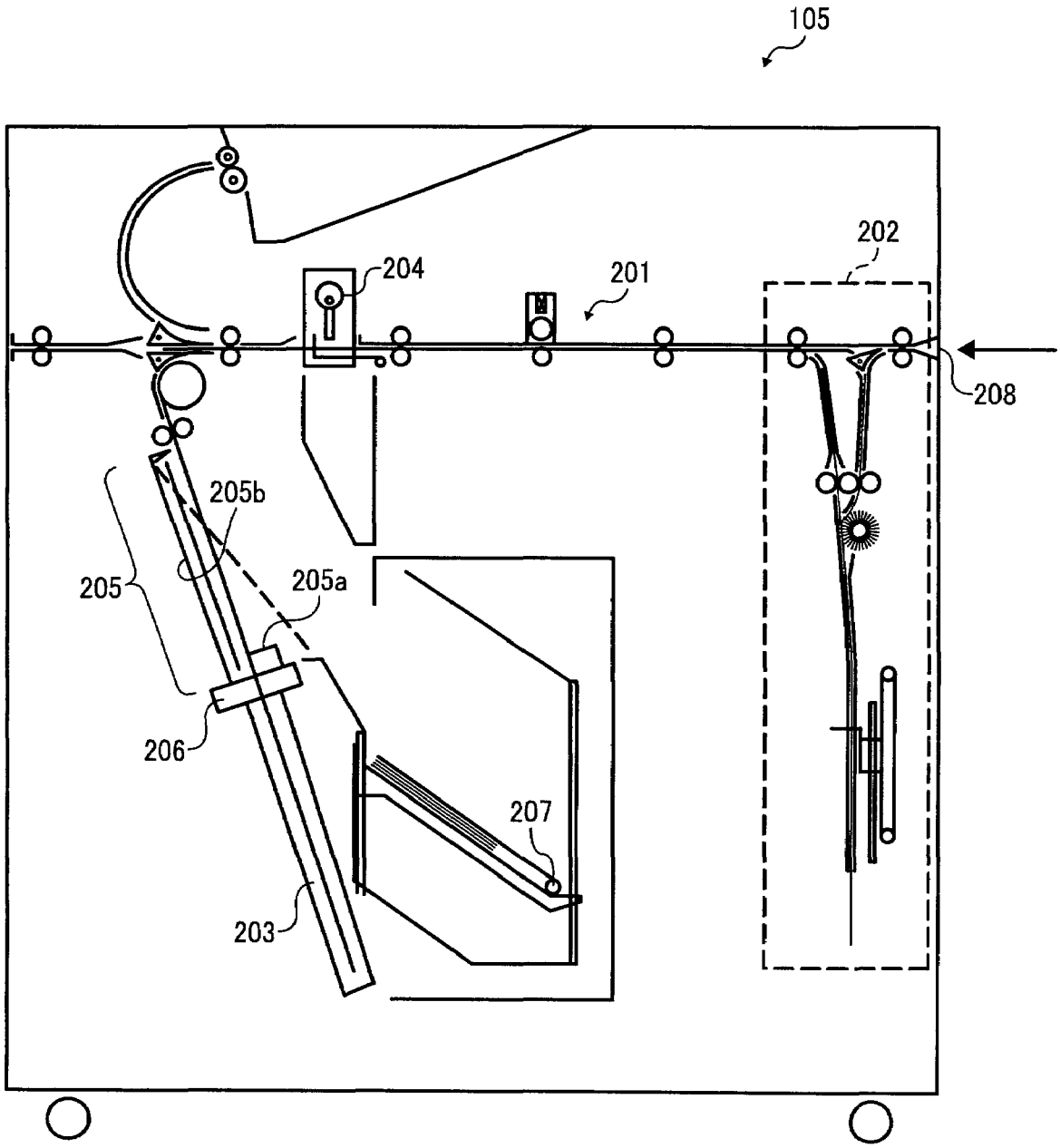
FIG. 2 is a schematic diagram of a ring binding device shown in FIG. 1.

FIG. 2 is a schematic diagram of the ring binding device 105. The ring binding device 105 includes a sheet entrance 208 from which a sheets is conveyed into the ring binding device 105, a through path 201 through which the sheet passes, an inverting unit 202 that inverts the sheet at an end of the through path 201, a ring-member cartridge 203 that stores therein a plurality of types of ring members corresponding respectively to different maximum total thicknesses of sheets that can be bound with the ring member of each type, a punching unit 204 that punches the sheet inverted by the inverting unit 202 on the through path 201, an adjusting unit 205 on which sheets punched by the punching unit 204 are temporarily stacked, a binding unit 206 that binds the sheets into a bundle with a ring member, and a stacker 207 to which the bundle of sheets is, or not-bound sheets are discharged from the adjusting unit 205.

The ring-member cartridge 203 is provided below the binding unit 206, and separately stores therein a 50-sheet ring member with which 50 sheets can be bound at maximum (i.e., the 50-sheet ring member has a maximum binding volume of 50 sheets) and a 100-sheet ring member having a maximum binding volume of 100 sheets.

The adjusting unit 205 stores punched sheets until the volume of punched sheets reaches a specific volume, or until the copier 106 instructs the ring binding device 105 to bind the sheets. The adjusting unit 205 includes a sheet-thickness sensor 205*a* that detects a total thickness of sheets stacked on the adjusting unit 205, and that sends thickness information that represents the detected thickness to the copier 106. The adjusting unit 205 includes a tray unit 205*b* that is configured to slant as indicated by a dotted line shown in FIG. 2, and the bundle of sheets bound by the binding unit 206 is discharged to the stacker 207.

The binding unit 206 binds sheets stacked on the adjusting unit 205 into a bundle with a ring member specified by the copier 106. The copier 106 can also instruct the binding unit 206 to discharge the sheets to the stacker 207 without binding the sheets. Thereafter, the bundles of sheets or not-bound sheets are stacked on the stacker 207 sequentially.

A hardware configuration of the control device 101 shown in FIG. 1 is a microcomputer that includes a central processing unit (CPU) 101*a*, a memory 101*b*, such as a read only memory (ROM), a random access memory (RAM), and a flash memory.

Figure 3:
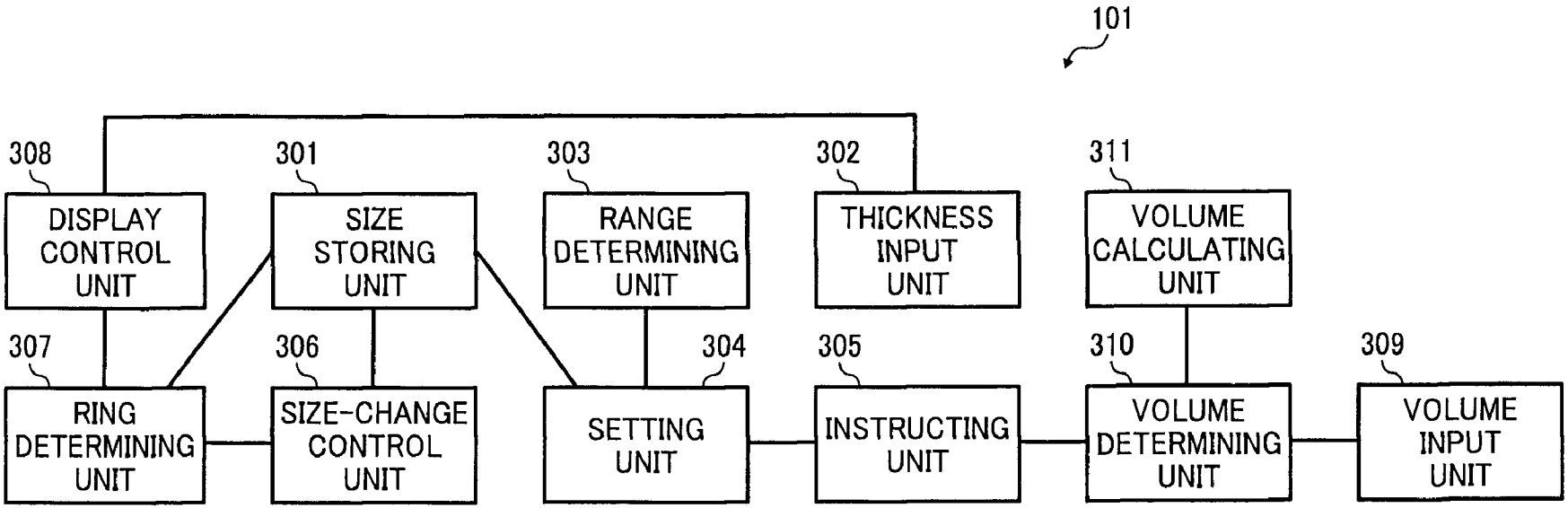
FIG. 3 is a block diagram of a control device shown in FIG. 1.

FIG. 3 is a block diagram of the control device 101. The control device 101 includes a size storing unit 301, a thickness input unit 302, a range determining unit 303, a setting unit 304, an instructing unit 305, a size-change control unit 306, a ring determining unit 307, a display control unit 308, a volume input unit 309, a volume determining unit 310, and a volume calculating unit 311, all of which can be implemented by the hardware configuration shown in FIG. 1. For example, the thickness input unit 302, the range determining unit 303, the setting unit 304, the instructing unit 305, the size-change control unit 306, the ring determining unit 307, the display control unit 308, the volume input unit 309, the volume determining unit 310, and the volume calculating unit 311 are implemented as software on the CPU 101*a* by loading appropriate programs stored in the memory 101*b* to the CPU 101*a* and executing the programs.

The size storing unit 301 is included in the memory 101*b*, and stores therein a size of a ring member with which sheets are to be bound. The size can be automatically set at the time of performing an initialization, or an operator can set the size by operating the operation panel 102.

The display control unit 308 performs processing for causing the operation panel 102 to display information on a total thickness of sheets stacked on the adjusting unit 205 or a message prompting an operator to select whether to change the ring member.

The ring determining unit 307 determines whether the ring binding device 105 stores therein a ring member having a size larger than that of the size stored in the size storing unit 301 (hereinafter, "stored size"). The ring-member cartridge 203 includes a detecting unit (not shown) that detects sizes of ring members stored in the ring-member cartridge 203. The detected size of ring member is input to the ring determining unit 307, based on which, the ring determining unit 307 determines whether the ring binding device 105 stores therein a ring member having a size larger than the stored size.

The ring determining unit 307 determines whether the operator requires the sheets stacked on the adjusting unit 205 to be bound into a bundle with a ring member having the stored size.

The sheet-thickness sensor 205*a* detects the total thickness of sheets stacked on the adjusting unit 205. Information on the total thickness (hereinafter, "total-thickness information") detected by the sheet-thickness sensor 205*a* is output from the sheet-thickness sensor 205*a* every time when each sheet is stacked on the adjusting unit 205. The thickness input unit 302 inputs the total-thickness information to the range determining unit 303.

The total-thickness information is output every time when each sheet is stacked on the adjusting unit 205. Alternatively, the sheet-thickness sensor 205*a* can be configured to output total-thickness information when the total thickness of the sheets stacked on the adjusting unit 205 reaches an allowable range. The allowable range is a range of a total thickness of sheets that are allowed to be bound with a ring member having the stored size.

The range determining unit 303 determines whether the thickness indicated by the total-thickness information is within the allowable range.

A value in the allowable range is more than a minimum value Xmin representing a minimum total thickness of sheets that are allowed to be bound with a ring member having the stored size and equal to or less than a maximum value Xmax representing a maximum total thickness of sheets that can be bound into a bundle with a ring member having the stored size.

The minimum value Xmin is defined by standards of ring a member having the stored size. Because the minimum value Xmin is set, the volume of sheets to be bound with a ring member of each type can as large as possible in a best-ring-selecting mode, which is explained below.

The maximum value Xmax is larger than the minimum thickness Xmin. Because the maximum value Xmax is set, sheets having a large total thickness that may damage the ring binding device 105 can be prevented from being bound. In addition, because sheets having a total thickness larger than the maximum value Xmax are not bound, a case can be prevented that each sheet cannot be turned over easily.

The setting unit 304 changes a size of a ring member stored in the size storing unit 301. For example, when the range determining unit 303 determines that the total-thickness information represents a thickness less than the minimum value Xmin or is more than the maximum value Xmax, the setting unit 304 changes the stored size to a different size.

Specifically, when the thickness represented by the total-thickness information is larger than the maximum value Xmax, the setting unit 304 changes the stored size to a larger size. On the other hand, when the thickness is equal to the minimum value Xmin or less, the setting unit 304 changes the stored size to a smaller size.

When the thickness is out of the allowable range, the setting unit 304 changes the stored size in response to an instruction issued by the operator. Alternatively, the setting unit 304 can be configured to change the stored size based on the thickness represented by the input total-thickness information without instruction issued by the operator.

The size-change control unit 306 performs changes a ring member having the stored size as ring a member to be used to bind sheets. According to the embodiment, the size-change control unit 306 controls the binding unit 206 such that sheets are bound with a ring member having the stored size. Alternatively, for example, an operator can manually change the ring member to be used to bind sheets in the binding unit 206.

A counting unit (not shown) counts the volume of sheets stacked on the adjusting unit 205 (hereinafter, "sheet volume"). The volume input unit 309 inputs volume information representing the number (volume) of sheets counted by the counting unit.

Based on a maximum volumes of sheets that can be bound with a ring member having the stored size, the volume calculating unit 311 calculates a volume (number) of sheets by equally dividing the volume of original sheets read by the reading device 103.

Based on output conditions (for example, a combined printing or a duplex printing), which are previously set, the volume calculating unit 311 calculates the number (volume) of sheets necessary for outputting data on all original sheets read by the reading device 103 (hereinafter, "necessary volume"). Subsequently, based on the maximum volume, the volume calculating unit 311 calculates a value by which the calculated volume can be equally divided.

The output condition is, for example, a mode in which the volume of printed sheets to be output is different from the volume of original sheets. For example, when double-sided printing is set as the output condition, ten original sheets are printed in five sheets and the five sheets are discharged to the ring binding device 105.

The volume determining unit 310 determines whether the sheet volume indicated by the volume information input by the volume input unit 309 reaches the volume calculated by the volume calculating unit 311. When the calculated volume is equal to the volume represented by the volume information, the volume determining unit 310 instructs the instructing unit 305 to issue an instruction for ring binding.

The instructing unit 305 instructs the ring binding device 105 to bind the sheets stacked on the adjusting unit 205 with a ring member having the stored size. Before issuing the instruction for ring binding to the ring binding device 105, the instructing unit 305 reads the stored size from the size storing unit 301, and confirms whether the sheets stacked on the adjusting unit 205 are not bound yet.

Figure 4:
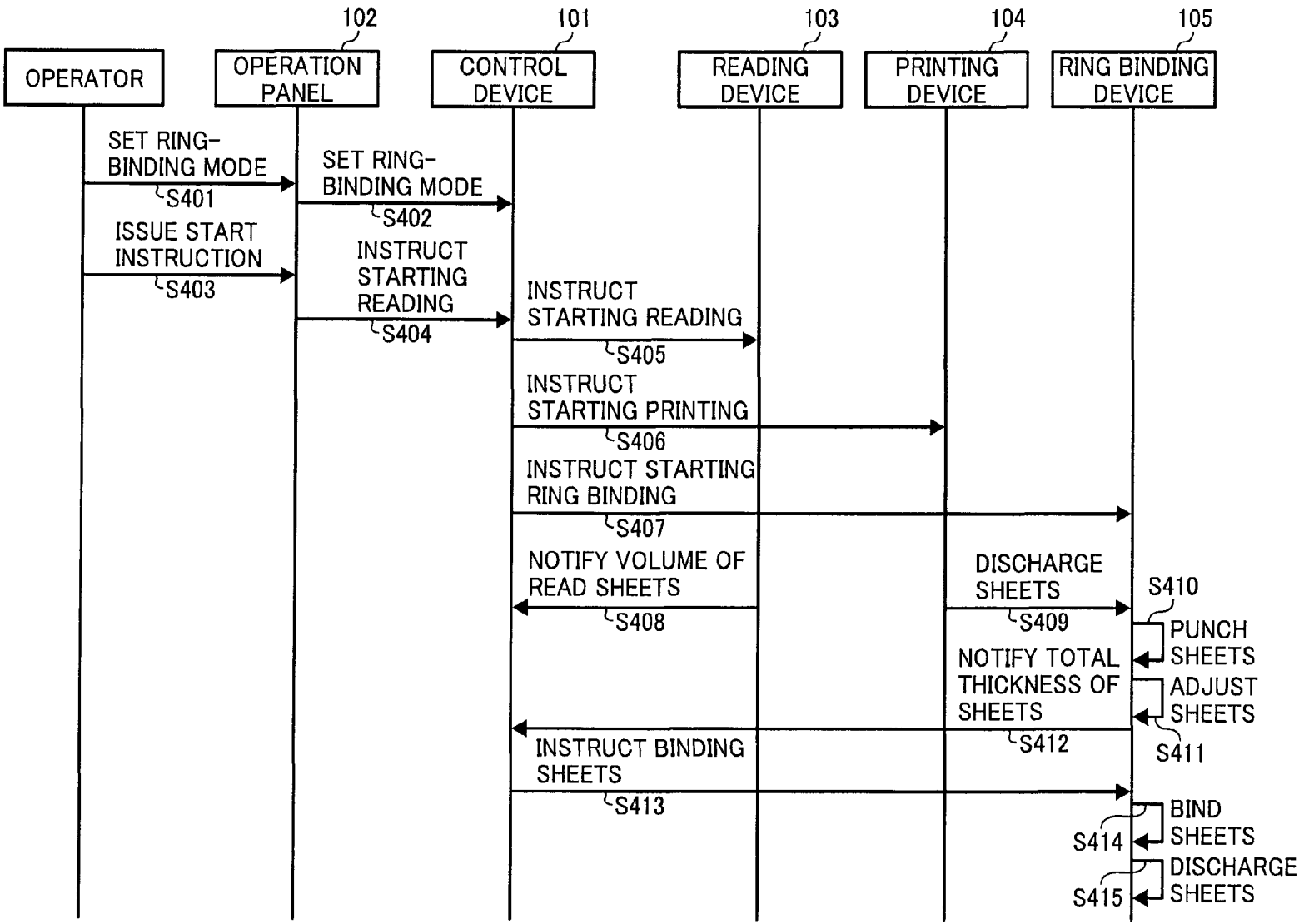
FIG. 4 is a sequence diagram of a process performed by the image forming apparatus in a ring-binding mode.

With reference to FIG. 4, a basic operation of the image forming apparatus 100 when the ring binding device 105 bind sheets into a bundle with a ring member (i.e., in a ring binding mode) is explained below.

An operator sets a ring-binding mode via the operation panel 102 (step S401). When the ring-binding mode is set, a size of a ring member to be used to bind sheets, the volume of sheets to be bound in a bundle, a side at which the sheets are bound, a best-ring selecting mode, an equal-volume mode, and the like, can be specified or selected. Values set when setting the ring-binding mode are temporarily stored in the memory 101*b* (step S402) and are used for the following processes as appropriate.

In the best-ring selecting mode, the sheets stored in the ring binding device 105 are divided into batches each having a thickness in the allowable range, and each of the batches is bound with a ring member having the stored size. On the other hand, in the equal-volume mode, the sheets stored in the ring binding device 105 are equally divided into batches based on the stored size such that the batches have equal thicknesses, and each of the batches is bound with a ring member having the stored size.

After setting the ring-binding mode, the operator issues a start instruction to the control device 101 via the operation panel 102 (step S403). Upon receiving the start instruction, the control device 101 instructs the reading device 103 to start reading original sheets (step S405), and instructs the printing device 104 to start printing (step S406). According to the instructions sent from the control device 101, the reading device 103 sequentially reads original sheets placed a ADF or a contact glass and the printing device 104 prints images onto sheets based on image data on the original sheets read by the reading device 103.

After the printing device 104 prints a first sheet, or after the operator sets the ring-binding mode, the control device 101 instructs the ring binding device 105 to start ring binding (step S407). Every time after reading each original sheet, or after reading all of the original sheets, the reading device 103 notifies the control device 101 of the volume of read original sheets (step S408). The printing device 104 discharges the sheets on which the image data are printed to the ring binding device 105 (step S409).

After the ring binding device 105 receives the instruction for ring binding from the control device 101, the punching unit 204 punches the printed sheets (step S410) and the punched sheets are temporarily stacked on the adjusting unit 205 and adjusted (step S411). The sheet-thickness sensor 205*a* detects the total thickness of the sheets stacked on the adjusting unit 205. The ring binding device 105 notifies the control device 101 of the total thickness of the sheets (step s412). The notification can be made every time when each sheet is stacked on the adjusting unit 205, or when the total thickness reaches a specific thickness.

The control device 101 instructs the ring binding device 105 to bind the sheets (step S413) that corresponds to the thickness that the control device 101 is notified of by the ring binding device 105. The sheets stacked on the adjusting unit 205 are conveyed to the binding unit 206. After the binding unit 206 binds the sheets into a bundle with a ring member specified by the control device 101 (step S414), the bundle of sheets is discharged to the stacker 207 (step S415). The control device 101 can instruct the binding unit 206 to discharging the sheets to the stacker 207 without bounding the sheets.

Figure 5:
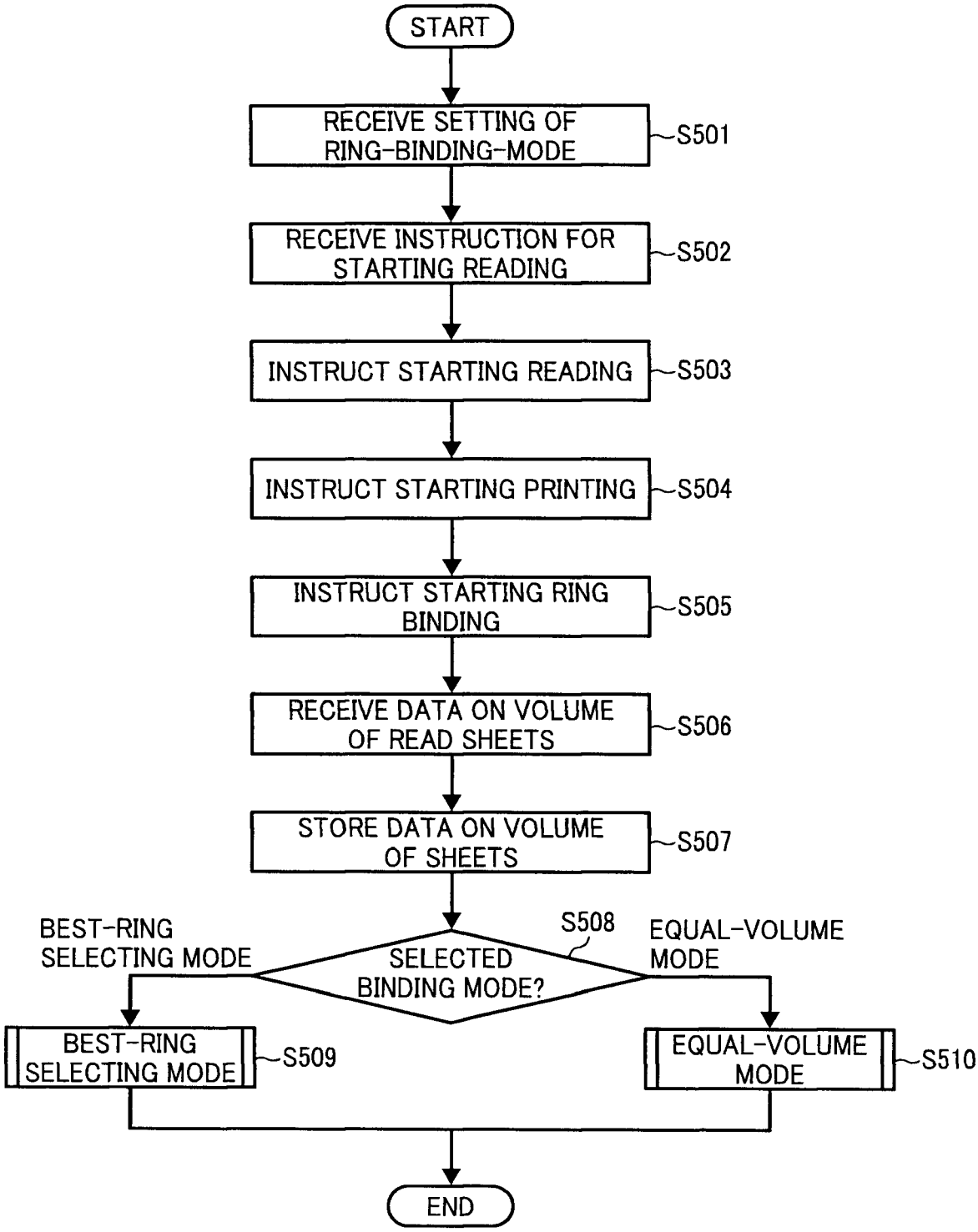
FIG. 5 is a flowchart of a process performed by the control device in the ring-binding mode.
Figure 6A:
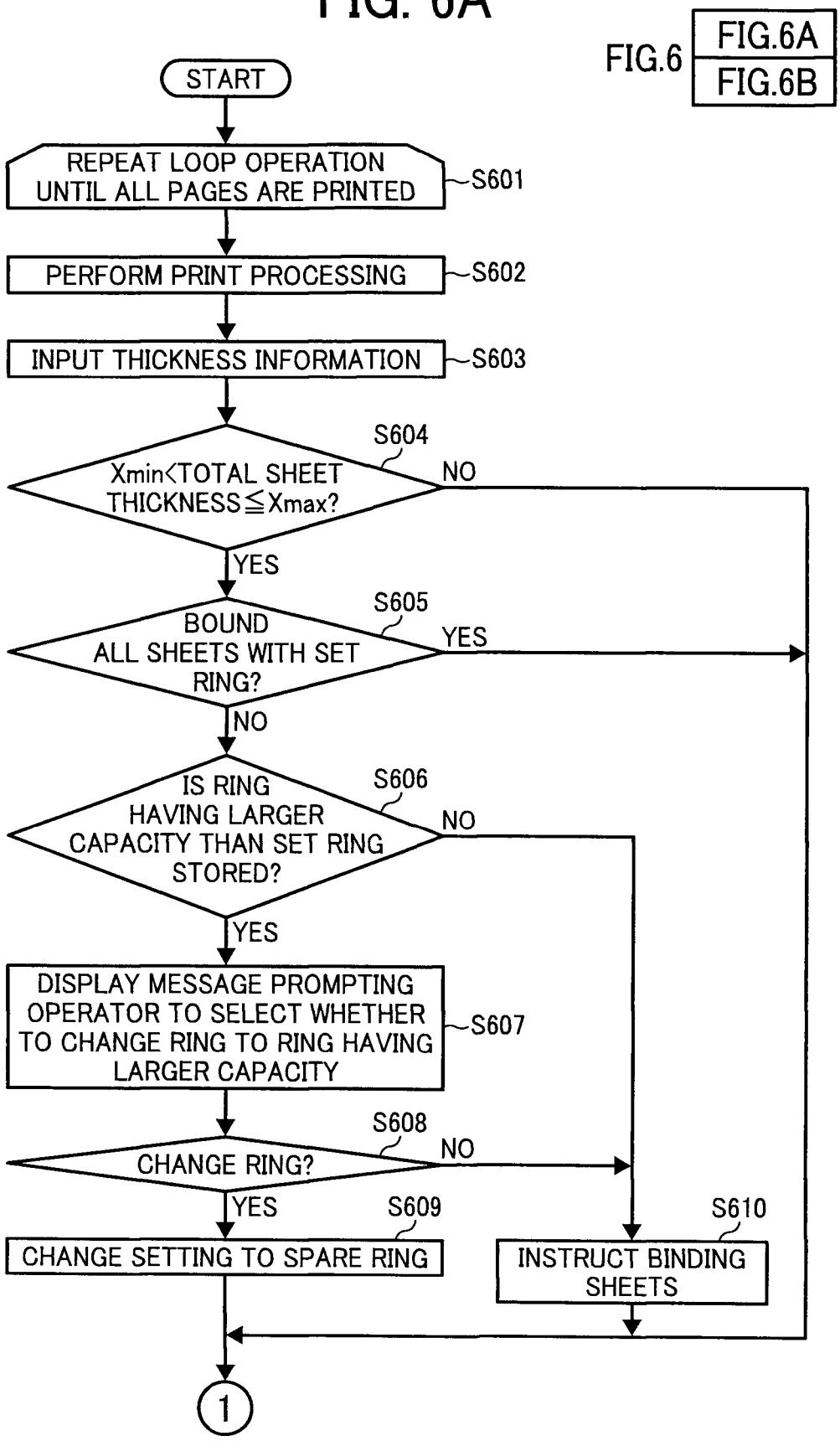
FIG. 6 is a flowchart of a process performed when an operator sets the ring-binding mode to a best-ring selecting mode.
Figure 6B:
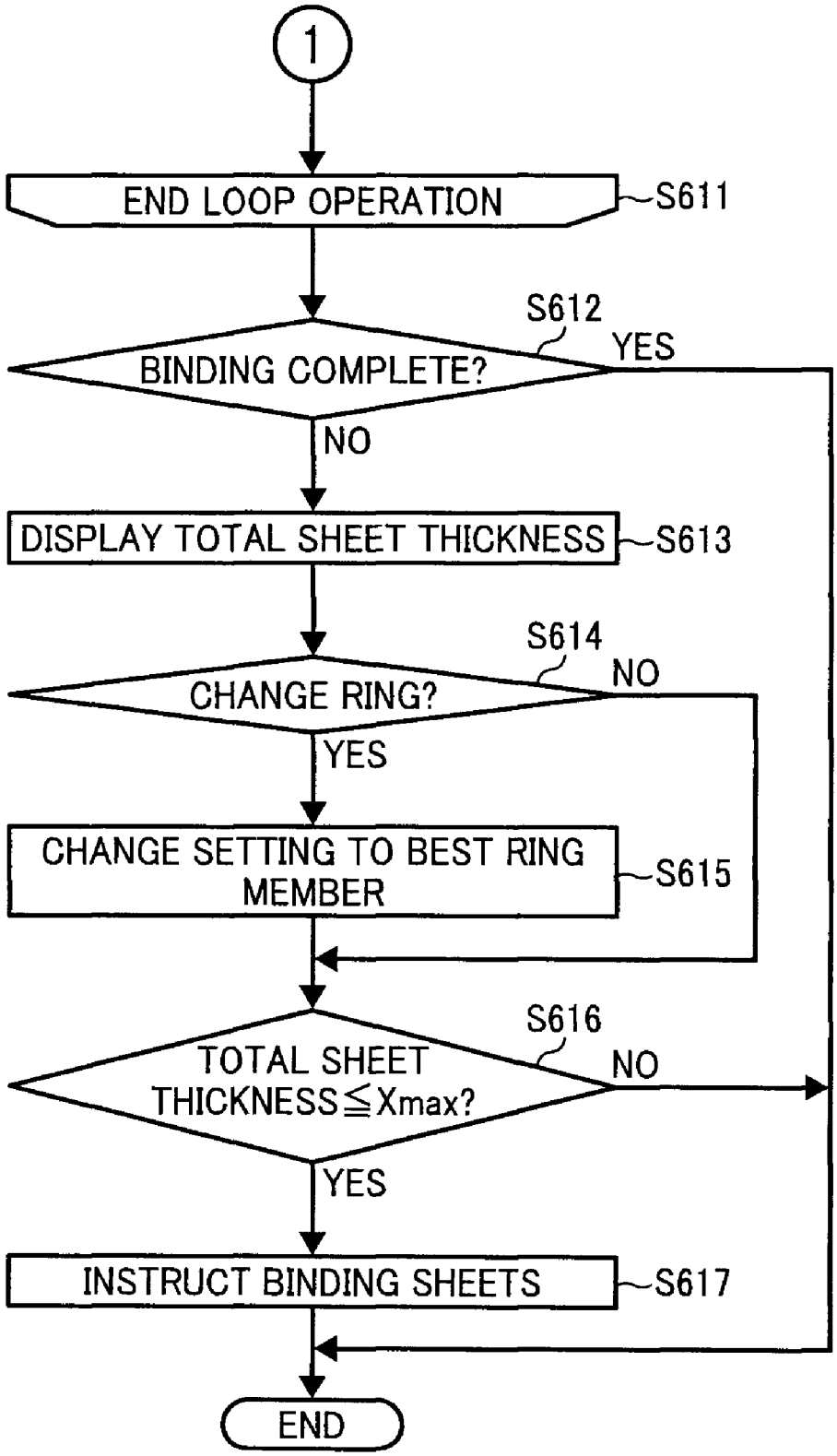
Figure 7:
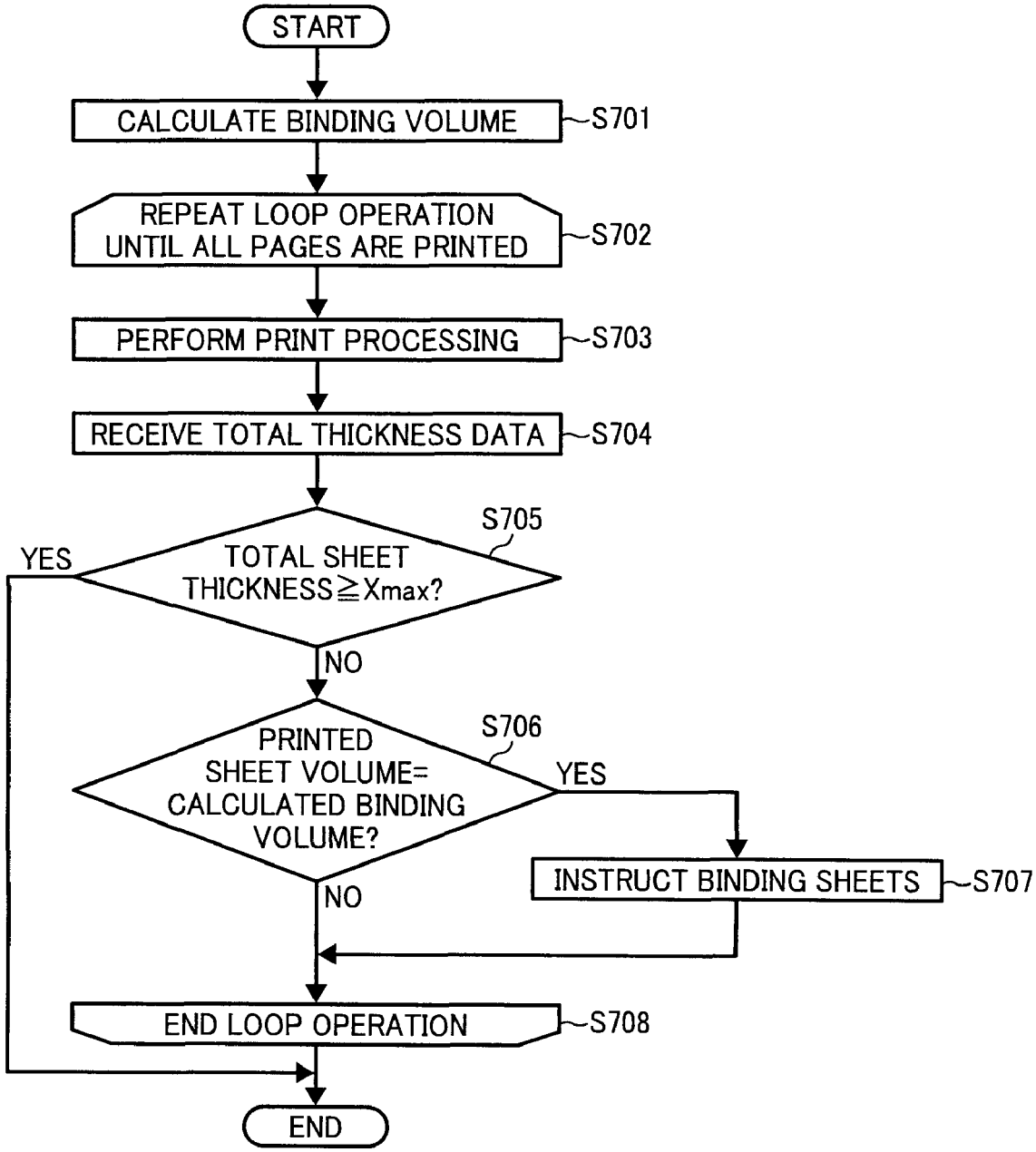
FIG. 7 is a flowchart of a process performed when an operator sets the ring-binding mode to an equal-volume mode.

A process performed by the image forming apparatus 100 in the ring-binding mode is explained with reference to FIGS. 5 to 7. FIG. 5 is a flowchart of a process performed by the control device 101 in the ring-binding mode. FIG. 6 is a flowchart of a process performed when an operator sets the best-ring selecting mode. FIG. 7 is a flowchart of a process performed when an operator sets the equal-volume mode.

Before the process shown in FIG. 5 is performed, the operator sets the ring-binding mode (step S401 shown in FIG. 4) and issues the start instruction to the control device 101 (step S403 shown in FIG. 4).

The control device 101 receives setting of the ring binding mode via the operation panel (step S501) and receives, from the operation panel 102, the instruction for starting reading the original sheets (step S502). According to the ring-binding mode and the instruction, the control device 101 instructs the reading device 103 to reading the original (step S503). The control device 101 instructs the printing device 104 to start printing (step S504), and instructions the ring binding device 105 to bind the sheets (step S505). The reading device 103 notifies the control device 101 of the volume of sheets read by the reading device 103 (step S506), and stores the volume in the memory 101*b* (step S507). The control device 101 is notified of the sheet volume every time when each sheet is read or all of the original sheets are read by the reading device 103. Steps S501 to S507 correspond to step S402 and steps S404 to S408.

The control device 101 determines whether the ring-binding mode set by the operator is the best-ring selecting mode or the equal-volume mode (step S508). When the best-ring selecting mode is set as the ring-binding mode, the process control goes to step S509. When the equal-volume mode is set as the ring-binding mode is, the process control goes to step S510.

FIG. 6 is a flow chart of step S509. Steps S601 to S611 are repeated until the printing device 104 prints all pages.

The control device 101 controls the printing process until all of the original sheets read by the reading device 103 are printed (step S602).

The thickness input unit 302 inputs the total-thickness information from the ring binding device 105 (step S603) to the control device 101. According to the first embodiment, the thickness input unit 302 inputs the total-thickness information every time when each sheet is stacked on the adjusting unit 205. Alternatively, the thickness input unit 302 can be configured to input the total-thickness information the total thickness is within the allowable range in which the sheets can be bound with a ring member having the stored size. According to the first embodiment, the control device 101 stores the input total-thickness data (i.e., total-thickness information) in the memory 101*b* and increments the total-thickness data every time when the total-thickness information is input.

Once the thickness input unit 302 inputs the total-thickness information, the range determining unit 303 determines whether the thickness is in the allowable range by comparing the thickness represented by the input total-thickness data with the maximum total thickness of sheets that can be bound with a ring member having the stored size (step S604). When the total-thickness data represents a thickness more than the minimum value Xmin and equal to or less than the maximum value Xmax, i.e., the thickness is within the allowable range (Yes at step S604), the ring determining unit 307 determines whether the operator requires all of the sheets to be bound into a bundle with rings having the stored size (step S605) based on the result of the setting of the ring bind mode by the operator (step S401 shown in FIG. 4).

When the operator does not require all of the sheets to be bound into a bundle with a ring having the stored size, i.e., the operator requires the sheets to be divided into batches based on the maximum total thickness, (No at step S605), the ring determining unit 307 determines whether the ring-member cartridge 203 stores therein a ring member with which more sheets can be bound into a bundle compared with a case where a ring member having the stored size is used (step S606). When the ring-member cartridge 203 stores therein a ring member with which more sheets can be bound compared with a case where a ring member having the stored size is used (Yes at step S606), the display control unit 308 displays a message prompting the operator to select whether to change the ring member to a ring member with which more sheets can be bound (step S607 and S608).

If the operator selects to change the stored size, the setting unit 304 changes the stored size to a size of a ring member with which more sheets can be bound (Step S609). Alternatively, the setting unit 304 can be configured to change the stored size without an operation by the operator. In this case, based on the size newly set by the setting unit 304, the size-change control unit 306 changes a ring member to be used to bind the sheets. If the setting unit 304 changes the stored size to a different size in the size storing unit 301, the ring binding is not to be performed and the process control goes to steps S612.

On the other hand, when the ring-member cartridge 203 does not store therein a ring member with which more sheets can be bound compared with the case where a ring member having the stored size are used (No at step S606), or the operator selects not to change the ring member (No at step S608), the instructing unit 305 instructs the ring binding device 105 to bind the sheets (step S610).

When the ring determining unit 307 determines that the operator requires all of the sheets to be bound into a bundle with a ring member having the stored size (Yes at step S605), the ring binding device 105 does not perform ring binding until a loop printing operation from step S601 to step S611 is completed, and steps S602 to S605 are repeated. After the printing device 104 prints out all sheets, the instructing unit 305 determines whether the sheets have been already bound (step S612). When the instructing unit 305 determines that the sheets are not bound yet (No at step S612), the display control unit 308 causes the operation panel 102 to display a message prompting the operator to selects whether to change the ring member (step S613) waits the operator to make a selection (step S614).

For example, when the 100-sheet ring member and the 50-sheet ring member are available and the operator sets the size of the 100-sheet ring member in the size storing unit 301, the best ring member for binding 50 sheets or less is the 50-sheet ring member. When a ring member having a size more suitable than the stored size is stored in the ring-member cartridge 203, the stored size is changed to a suitable size by the setting unit 304 automatically or after a message prompting the operator to select whether to change the ring member is displayed on the operation panel 102.

The range determining unit 303 compares the maximum total thickness of sheets that can be bound with a ring member having the stored size and the thickness represented by the sheet-thickness data, and determines whether the thickness represented by the sheet-thickness data is equal to or less than the maximum value Xmax. When the thickness is equal to or less than the maximum value Xmax (Yes at step S616), the instructing unit 305 instructs the ring binding device 105 to bind the sheets (step S617).

In this manner, sheets having a total thickness more than the maximum value Xmax can be prevented from being bound, which prevents the ring binding device 105 from being damaged. Sheets having the total thickness more than the maximum value Xmax are not bound and directly discharged to the stacker 207. Therefore, the operator can bind the sheets by putting, for example, a string through holes made by the punching unit 204 and tying the sheets.

When the thickness represented by the sheet-thickness data is more than the maximum value Xmax (No at step S616), the process control is completed. The instructing unit 305 determines that the sheets have been already bound at step S612 if the process control proceeds in any one of the following three manners:

(1) No at step S605→No at step S606→step S610;

(2) No at step S605→Yes at step S606→No at step S608→step S610; and (3) No at step S605→Yes at step S606→Yes at step S610→Yes at step S608→step S609→step S602→No at step S605→No at step S606→step S610.

Examples 1 to 4 of the above cases are explained below.

Example 1 is a case where sheets are bound with a ring member having a size smaller than the stored size. In this case, the two types of ring members, i.e., the 50-sheet ring member and the 100-sheet ring member, are stored in the ring-member cartridge 203, 40 original sheets are to be read, and an operator sets, in the size storing unit 301, the size of the 100-sheet ring member. In this case, the 50-sheet ring member is the best ring member. From step S601 to step S611, the control device 101 receives the total-thickness information and stores the total-thickness information in the memory 101*b*. However, the control device 101 does not perform processing for ring binding. When the control device 101 determines that the sheets are not bound yet at step S612 and compares the total thickness of 40 sheets and the maximum value Xmax corresponding to the stored size. Because the 50-sheet ring member more suitable than the 100-sheet ring member is stored in the ring-member cartridge 203, the ring member is changed at step S615 and the control device 101 instructs the ring binding device 105 to bind the sheets. In this manner, the sheets are bound with the ring member having a size smaller than the stored size.

Example 2 is a case where sheets cannot be bound with a ring member having the set size and thus is bound with a ring member having a size larger than the set size. In this case, the 50-sheet ring member and the 100-sheet ring member are stored in the ring-member cartridge 203, 80 original sheets are to be read, an operator sets the size of the 50-sheet ring member in the size storing unit 301, and the operator issues the start instruction. Because the size of the 50-sheet ring member is set in the size storing unit 301, the control device 101 receives the total sheet-thickness information representing a total thickness of 50 sheets from the ring binding device 105.

Because the thickness represented by the total sheet-thickness information is within the allowable range, the control device 101 makes a determination at step S606. Because the ring-member cartridge 203 stores therein the 100-sheet ring member having a size larger than the stored size, i.e., the size of the 50-sheet ring member, the 50-sheet ring member is changed to the 100-sheet ring member at step S608. With the change of the ring member, ring binding is not performed and printing of all pages is completed. Thereafter, the ring member is not changed. At step S616, the range determining unit 303 determines that the thickness represented by the sheet-thickness data is within the allowable range of the maximum total thickness of the 100-ring member, and the instructing unit 305 instructs the ring binding device 105 to bind the sheets at step S617.

Example 3 is a case where sheets are discharged without being bound. In this case, the 50-sheet ring member and the 100-sheet ring member are stored in the ring-member cartridge 203 and approximately 100 original sheets are to be read. Thus, an operator sets the size of the 100-sheet ring member in the size storing unit 301, and issues the start instruction. Because approximately 100 sheets are printed, the operator gives an instruction not for performing double-sided printing but for performing single-sided printing. However, after the printing is completed, the operator realizes that 120 sheets are printed. The 120 sheets can be divided into two batches and the sheets in each batch can be bound into a bundle with the 100-sheet ring member. However, if the 120 original sheets are printed by double-sided printing, the printed sheets can be bound into a bundle with one 100-sheet ring member. Thus, the operator decides to change the setting in consideration of the costs.

Thereafter, the operator instructs not performing ring binding so that the sheets are discharged without being bound. Accordingly, sheets having a total thickness more than the maximum value Xmax can be prevented from being bound, which prevents the ring binding device 105 to be damaged. Because the sheets are not bound and discharged, the operator can bind the sheets by putting, for example, a string through holes made by the pinching unit 204 and tying the sheets.

Example 4 is a case where sheets printed out based on one set of original sheets are divided into a plurality of batches, and each of the batches is bound with a ring member having the stored size.

For example, when 150 original sheets are printed, dividing the 150 sheets into 50 sheets, 50 sheets, and 50 sheets is better, rather than diving the 150 sheets into 100 sheets and 50 sheets, because the sheets are equally divided in the former case. For this reason, the operator sets the size of the 50-sheet ring member in the size storing unit 301, and issues the start instruction. Once the 50 sheets are printed, the operator is prompted to select whether to change the ring member at step S608. Because the operator requires each batch of 50 sheets to be bound to obtain three bundles of sheets, the ring member is not changed (No at step S608).

Example 5 is a case where sheets printed out based on one set of original sheets are divided into a smaller volume of batches and each of the batches of sheets is bound into a bundle. For example, 170 original sheets are printed. In this case, to obtain a smaller volume of bundles of printed sheets, dividing the 170 sheets into a batch of 100 sheets and a batch of 70 sheets and binding each of the batches of sheets into a bundle with the 100-ring member is preferable, rather than almost equally dividing the 170 sheets into four batches of 43 sheets, 43 sheets, 42 sheets, and 42 sheets, and binding each of the batches is into a bundle with the 50-sheet ring member. For this reason, even if the operator sets the size of the 50-sheet ring member in the size storing unit 301 and issues the start instruction, the operator selects to change the ring member when the operator is the operator is prompted to select whether to change the ring member at step S608.

Examples 1 to 5 can be realized depending on a combination of determinations to be made at steps S601 to S617. Each determination can be made the operator. For example, the operator can make determination when setting the ring binding mode at step S401, or the operator can select setting information as the combination of determinations when the printing is started.

The process shown in FIG. 7 is explained below. Steps S702 to S708 are repeated until the printing device 104 prints all pages. The volume calculating unit 311 calculates the volume (number) of sheets to be bound into a bundle with one ring (hereinafter, "binding volume") by equally dividing the volume of original sheets read by the reading device 103, which is stored in the memory 101*b*, based on the maximum volume of sheets that can be bound into a bundle with a ring member having the stored size (step S701).

The volume calculating unit 311 calculates the necessary volume based on output conditions (i.e., n-up printing, or double-sided printing) and the volume of read original sheets, which is stored in the memory 101*b*. Thereafter, based on the stored size, the volume calculating unit 311 determines the binding volume.

According to the first embodiment, original sheets read by the reading device 103 are printed. However, because it suffices that necessary volume is determined before printing is started, the control device 101 can control printing of a document previously read and stored in a memory (not shown) of the reading device 103 by storing the volume of all pages of the document.

Explanation is given below for a method of calculating the binding volume based on the necessary volume and the volume of sheets that can be bound into a bundle with a member having the stored size at maximum (hereinafter, "maximum sheet volume").

For example, a divided volume (number) of sheets is calculated base on Dnum=(Onum/Rmax), where when Rmax is the maximum sheet volume, Onum is the necessary volume, and Dnum is a divided volume of sheets. When Dnum is a value having a decimal, the decimal is round up. A binding volume is calculated based on Pnum=Onum/Dnum, where Pnum is a binding volume, Onum is the necessary volume, and Dnum is a divided volume of sheets. When the necessary volume Onum is not divisible by the divided volume Dnum, a corrected volume Mnum is calculated based on Mnum=Onum % Dnum, where % is a redundant operator.

In other words, because the corrected volume Mnum is larger than Dnum by one, each volume of sheets to be bound with each ring member can be uniform.

The necessary volume Onum can be calculated from a volume (number) of original sheets Inum and the output conditions. For example, when n-up printing is set to print two pages on each sheet, Onum=Inum/2. When double-sided printing is also set in this case, Onum=Inum/4.

Steps S702 to S708 are repeated until all of the read pages of the original sheets are printed. When the volume of printed sheets is equal to the binding volume, the instructing unit 305 instructs the ring binding device 105 bind the sheets (step S707).

The control device 101 controls printing processing until all of read pages are printed (step S703).

The thickness input unit 302 inputs the total-thickness information to the control device 101 via the sheet-thickness sensor 205*a*.

The range determining unit 303 determines whether the thickness indicated by the input total-thickness information is equal to or less than the maximum value Xmax (step S705). When the thickness is not equal to or less than the maximum value (No at step S705), the volume determining unit 310 compares the sheet volume with the binding volume calculated at step S701, and determines whether sheet volume is equal to the binding volume (step S706). When the sheet volume is equal to the binding volume (Yes at step S706), the instructing unit 305 instructs the ring binding device 105 to bind the sheets (step S707).

When the sheet volume is not equal to the binding volume (No at step S706), the process control returns to step S703 and print processing is continued until the sheet volume reaches the binding volume (step S707). At a time when the sheet volume reaches the binding volume, the instructing unit 305 instructs the ring binding device to bind the sheets and the process is completed.

In the above explanation, the sheet volume is compared with the binding volume when the binding volume is within the allowable range. For example, 50 sheets can be bound with the 50-sheet ring member regardless of a thickness of each sheet.

For example, the necessary volume $O_{num}$ is 124 and the printing condition is that one sheet is output per original sheet (i.e., double-sided printing, n-up printing, and the like, are not selected), and the operator performs setting for binding sheets with the 50-sheet ring member and issue instruction for ring binding. Because the 50-sheet ring member is used, Dnum=(124/50)=2.4 is satisfied at step S701. Because a decimal is round up, Dnum=3. In addition, the binding volume Pnum is represented by Pnum=124/3=41, and the corrected number Mnum is represented by Mnum=1. Based on this calculation, three batches of sheets (two 41-sheet batch, one 42-sheet batch) are to be output. In this manner, the printed sheets can be substantially equally divided.

In the above equal-volume mode, the batches of sheets are bound with ring members of a single type. In the equal-volume mode, a plurality of types of ring members may be used. In this case, sheets are divided into batches such that a ratio of a total thickness of each bundle to a maximum total thickness of sheets that can be bound with a ring member of each type is the same. When 120 sheets are equally divided into batches to bind each batch with the 50-sheet ring member, the 120 sheets are divided into three batches: 40 sheets, 40 sheets, and 40 sheets. On the other hand, the 100-sheet ring and the 50-sheet ring are used, the 120 sheets are divided into two batches: 80 sheets to be bind with the 100 sheet ring member, and 40 sheets to be bound with the 50-sheet ring member. In other words, the thicknesses of the bundles are 80% of the respective maximum total thicknesses of the 100-sheet ring member and the 50-sheet ring member.

In the image forming apparatus 100 according to the first embodiment, the sheets are divided into bundles such that sheets in each bundle have a total thickness in the allowable range and the sheets in each bundle can be bound with a ring member having the size previously set. In other words, the sheets can be bound with a ring member having a size appropriate to the volume of sheets.

According to an aspect of the first embodiment, when the total sheet thickness detected in the ring binding device 105 is not within the allowable range, the size of the ring member can be changed. Therefore, a user can bind sheets in the best manner depending on the volume of sheets.

According to another aspect of the first embodiment, when the total sheet thickness detected in the ring binding device 105 is not within the allowable range, sheets are divided into batches of sheets that can be bound with a ring member having the size set. Therefore, it is not necessary to change the ring member before the sheets are bound.

According to still another aspect of the first embodiment, when the volume of sheets to be bound is more than the maximum volume of sheets that can be bound with a ring member having the size set, the sheets can be divided into batches of sheets that can be bound with an available largest ring, and the sheets in each batch are bound with the largest ring. Therefore, the sheets can be bound into the minimum number of bundles of sheets with the minimum number of the ring members.

According to still another aspect of the first embodiment, when the volume of sheets is more than a maximum volume of sheets that can be bound with a ring member having the size set, sheets are equally divided into batches and the sheets of each batch are bound into a bundle. Accordingly, each bundle of sheets can have a uniform thickness.

According to still another aspect of the first embodiment, by selecting one of the methods explained above, the operator can bind sheets in the most appropriate manner depending on purposes.

In the image forming apparatus 100 according to the first embodiment in the best-ring-selecting mode, sheets are divided into batches each having a thickness in an allowable rang and each of the sheets of each batch are bound into a bundle. However, when a plurality of sets of original sheets is output, it is unnecessary to select the best ring member for a second or subsequent set of sheets. In an image forming apparatus including a control device 800 according to a second embodiment of the present invention, a second or subsequent set of sheets are bound with a ring member having the size same as that of the ring member used for the first set of sheets.

Figure 8:
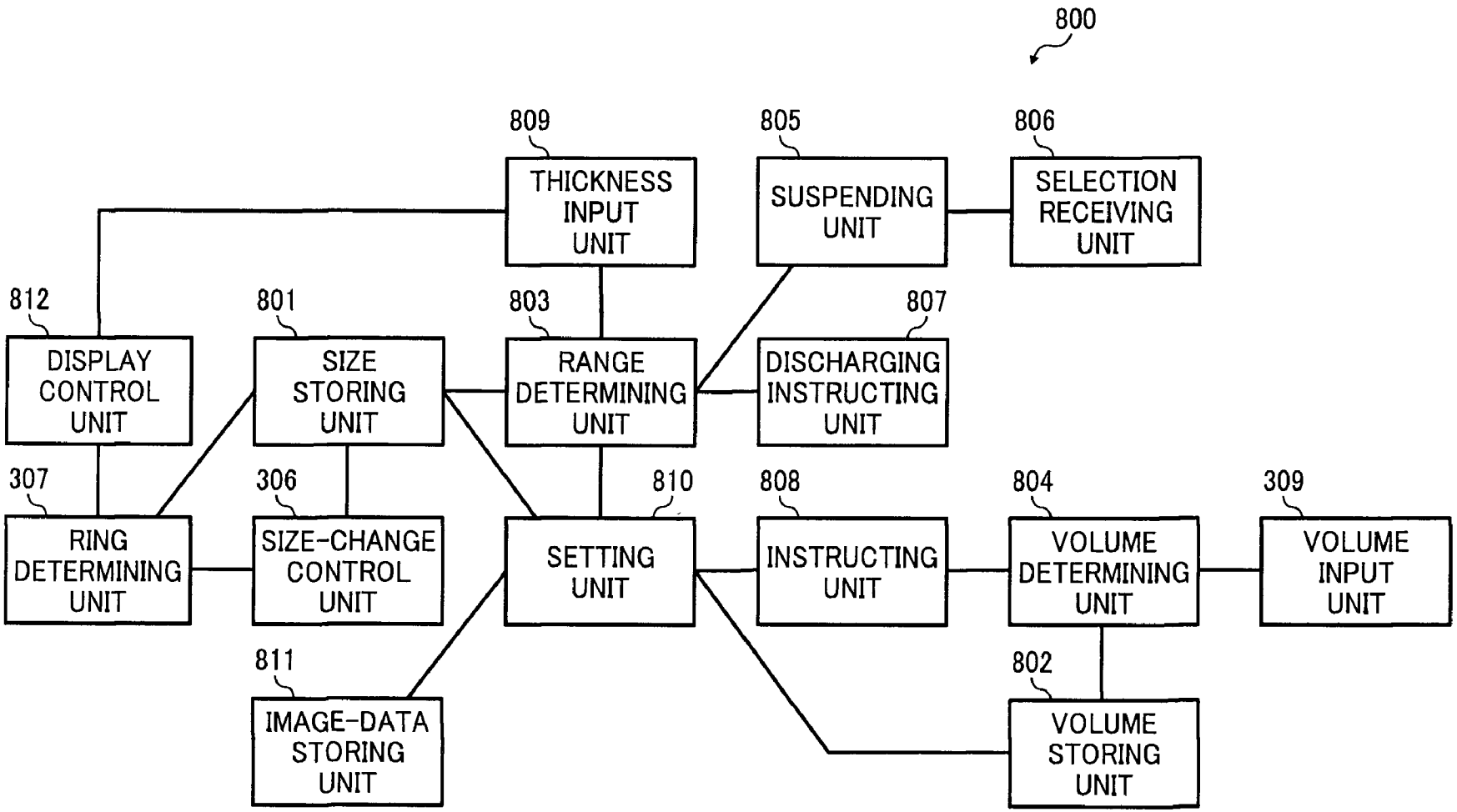
FIG. 8 is a block diagram of a control device of an image forming apparatus according to a second embodiment of the present invention.

FIG. 8 is a block diagram of the control device 800. The control device 800 includes a size storing unit 801 a range determining unit 803, a volume determining unit 804, an instructing unit 808, a thickness input unit 809, a setting unit 810, a volume storing unit 802, a suspending unit 805, a selection receiving unit 806, an image-data storing unit 811, and a display control unit 812. In the explanation given below, the same components explained in the first embodiment is given the same reference numeral and explanation thereof is omitted.

The image-data storing unit 811 stores therein image data that having been printed by the printing device 104. The image data is stored in combination with various types of setting made when the ring binding process is performed on the sheets. The various types of setting are, for example, the volume of sheets on which image data is printed, the size of a ring member with which the sheets are bound, and the ring-binding mode set when the ring-binding is performed.

The size storing unit 801 stores the size of a ring member with which sheets of a first set have been bound. A ring member having the size same as that of the ring member with which the sheets of the first set are bound is used to bound sheets of a second set. When the image data stored in the image-data storing unit 811 is re-printed, the size storing unit 801 stores therein the size of the ring member that is stored in combination with the image data.

The volume storing unit 802 stores therein the volume of sheets of each batch of the first set stacked on the adjusting unit 205. A binding volume of a second or subsequent set of sheets is same as that of the first set.

When the image data stored in the image-data storing unit 811 is re-printed, the volume storing unit 802 stores therein the volume (number) of sheets that is stored in combination with the image data.

The thickness input unit 809 inputs total thickness information representing the total thickness of sheets stacked on the adjusting unit 205. The thickness input unit 809 inputs a near-full value and a full value notified by the ring binding device 105.

The full value is the maximum value Xmax explained in the first embodiment. The full value is larger than the minimum value Xmin, and represents a maximum total thickness of sheets that can be bound with a ring member having the size stored in the size storing unit 801 (stored size). Sheets having a total thickness larger than the full value may not be properly bound and may damage the ring binding device 105 in the worst case. The full value is defined by the size of a ring member to be used.

The near-full value is a reference value for the thickness of sheets. Even if the total thickness of sheets for which a printing instruction is already issued is added to the near-full value, the total value does not exceed the full value. In a copier that prints a second sheet after printing a first sheet, the near-full value is defined based on a maximum allowable thickness of a sheet that can pass through. In a copier that prints sheets continuously, the near-full value is defined based on a value obtained by multiplying the maximum allowable thickness of a sheet by a maximum volume of sheets that can exist in a conveying path.

The range determining unit 803 determines whether the total thickness represented by the total-thickness information on the sheets of the second set or subsequent set, which is input by the volume input unit 309 determines whether the total thickness is a near-full value or equal to or more than the full value (the maximum value Xmax).

When the range determining unit 803 determines that the total thickness is equal to or more than the full value, the suspending unit 805 suspends the stacking of sheets on the adjusting unit 205. Accordingly, sheets are stacked on the adjusting unit 205 such that the total thickness does not reach the full value. Thus, the ring binding device 105 can be prevented from being damaged by binding sheets having a total thickness equal to or more than the full value.

After the suspending unit 805 suspends the stacking of sheets on the adjusting unit 205, the operator can select whether to continue stacking of the sheets on the adjusting unit 205 by operating the operation panel, and the selection receiving unit 806 receives the selection.

A discharging instructing unit 807 instructs the ring binding device 105 to discharge the sheets stacked on the adjusting unit 205 to the stacker 207 when the range determining unit 803 determines the total thickness is equal to or more than the full value. In this manner, sheets having a total thickness equal to or more than the full value are not bound, which prevents the ring binding device 105 from being damaged.

The volume determining unit 804 determines whether the sheet volume of the second or subsequent set is equal to that of the first set, which is stored in the volume storing unit 802. When the two sheet volumes are the same, the volume determining unit 804 notifies the instructing unit 808 that the sheet volumes are the same.

The volume determining unit 804 also determines whether the volume indicated by the volume information is of the first set of sheets, based on whether the volume storing unit 802 stores therein the volume of sheets of the current set in combination with the image data to be printed. When determining that sheets are of the first, the volume determining unit 804 determines whether the volume of the current set of sheets is equal to the volume of original sheets having read by the reading device 103.

When the volume determining unit 804 determines the volume of the current set of sheets is equal to that of the first set, which is stored in the volume storing unit 802, the instructing unit 808 instructs the ring binding device 105 to bind the sheets.

The setting unit 810 changes the size of a ring member stored in the size storing unit 801 to the size of the ring member used to bind the first set of sheets.

When the ring binding processing is performed on sheets that are output after the image data stored in the image-data storing unit 811 is re-printed on the sheets, the setting unit 810 reads, from the image-data storing unit 811, the size of the ring member and the sheet volume that are stored in combination with the image data. Thereafter, the setting unit 810 stores the read size, which is read from the image-data storing unit 811, in the size storing unit 801 in combination with the image data, and stores the sheet volume, which is read from the image-data storing unit 811, in the volume storing unit 802 in combination with the image data.

The display control unit 812 displays a warning message on the operation panel 102 when the thickness input unit 809 inputs the full value. The warning message requires an operator to select continuation or cancellation. When the operator selects the continuation, the instructing unit 808 instructs the ring binding device 105 to discharge the sheets stacked on the adjusting unit 205. When the operator selects the cancellation, the instructing unit 808 instructs the ring binding device 105 to discharge the sheets stacked on the adjusting unit 205 and the printing device 104 is instructed to terminate printing the remaining image data.

When the ring determining unit 307 determines that the ring binding device 105 stores no ring members having the size stored in the size storing unit 801 (stored size), the display control unit 812 displays on the operation panel 102 a message prompting the operator to cancel the ring-binding processing or replenish ring members.

Figure 9A:
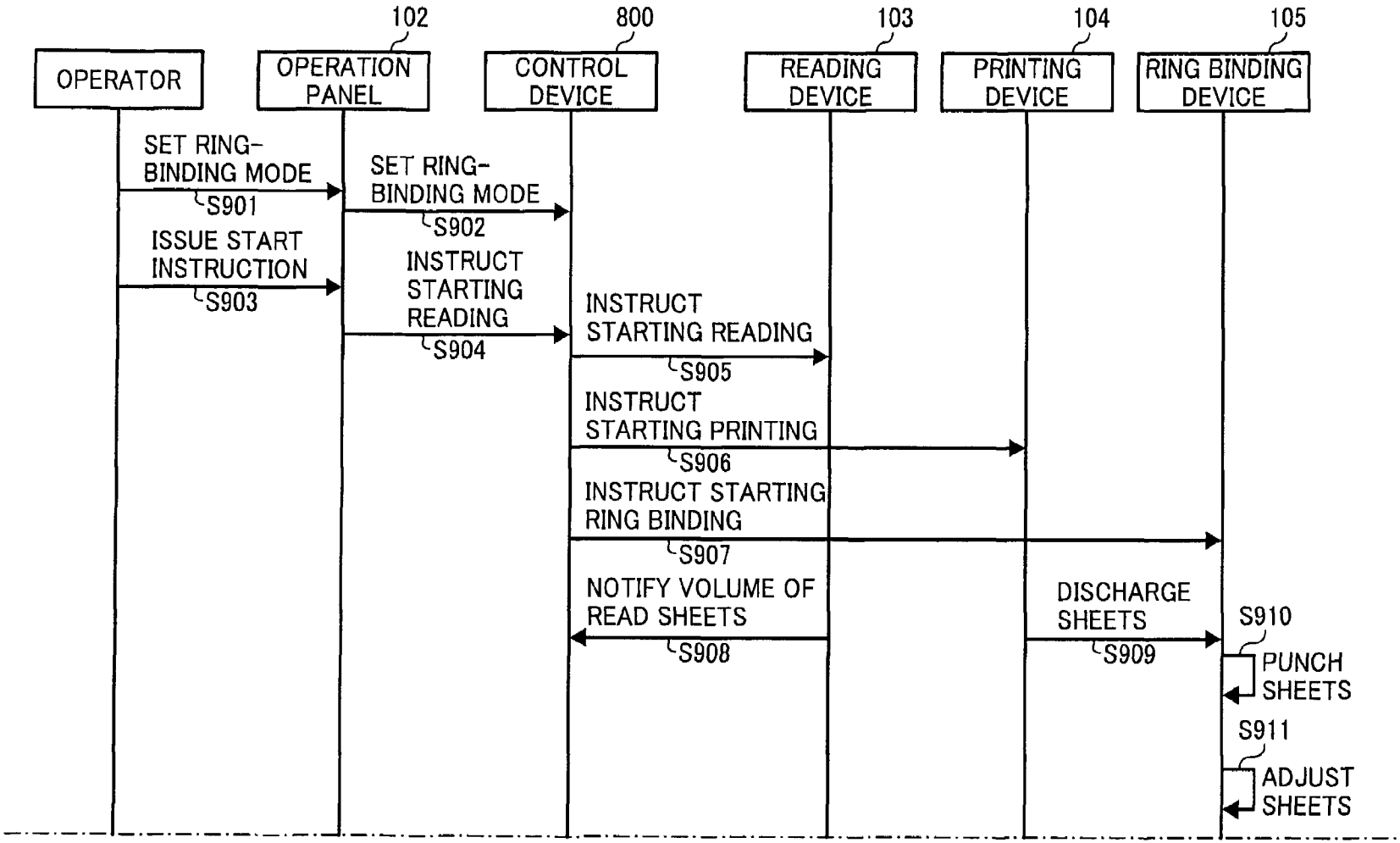
FIG. 9 is a sequence diagram of a process of the image forming apparatus.
Figure 9B:
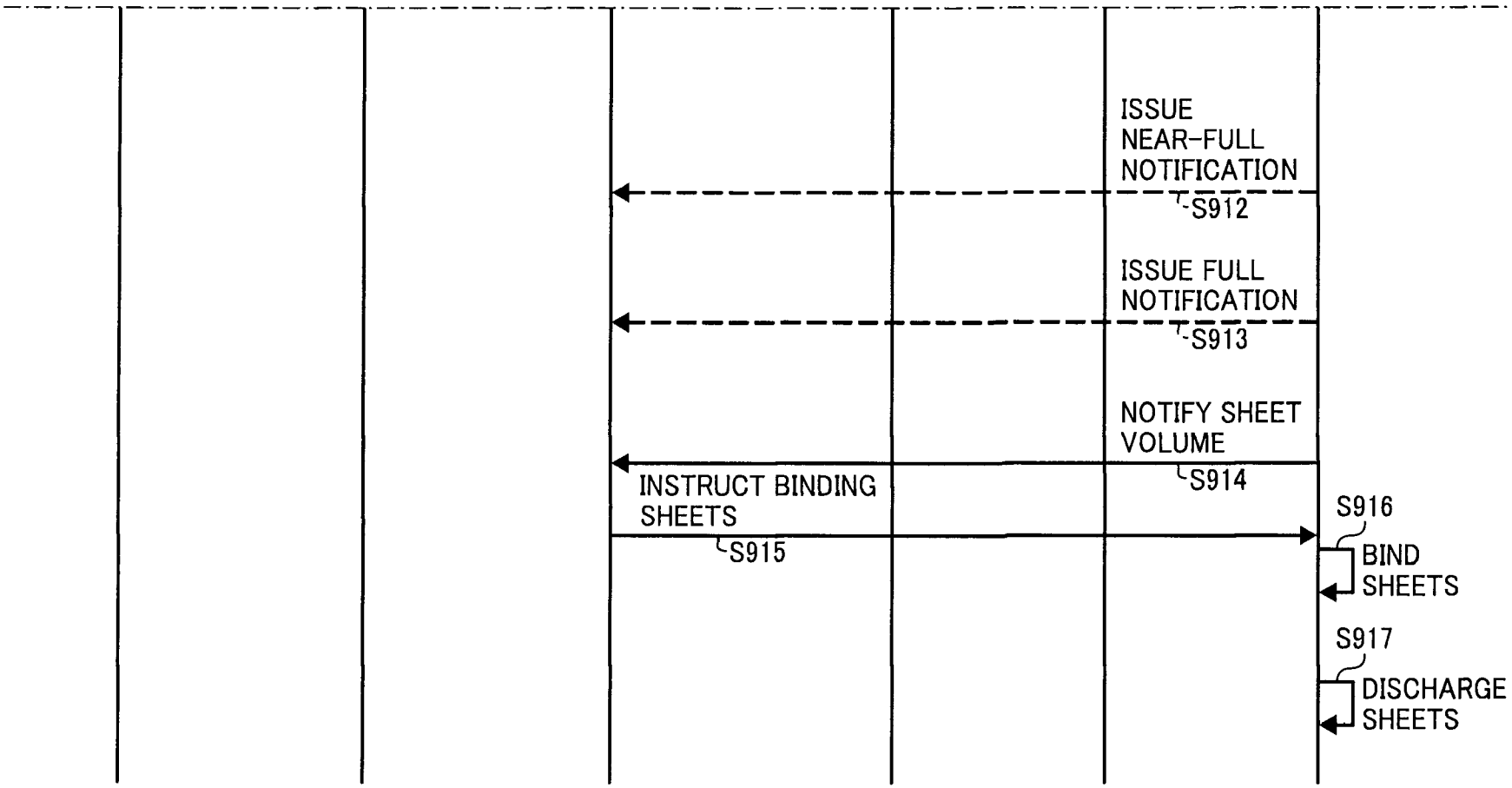

FIG. 9 is a sequence chart of a basic operation of the ring binding device 105 in the ring-binding mode. Steps S901 to S911 are identical to steps S401 to S411 shown in FIG. 4, and Steps S915 to S917 are identical to steps S413 to S415 shown in FIG. 4.

The ring binding device 105 recognizes the near-full value and the full value of the total thickness of sheets stacked on the adjusting unit 205. The ring binding device 105 issues a near-full notification to the control device 800 when the total thickness exceeds the near full value (step S912), and issues a full notification to the control device 800 when the total thickness exceeds the full value (step S913).

The ring binding device 105 includes a counting unit (not shown) that counts the volume (number) of sheets discharged from the printing device 104 and stacked on the adjusting unit 205. When the last sheet of each set is output from the printing device 104 and stacked on the adjusting unit 205, the control device 800 is notified of the sheet volume (step S914).

Figure 10:
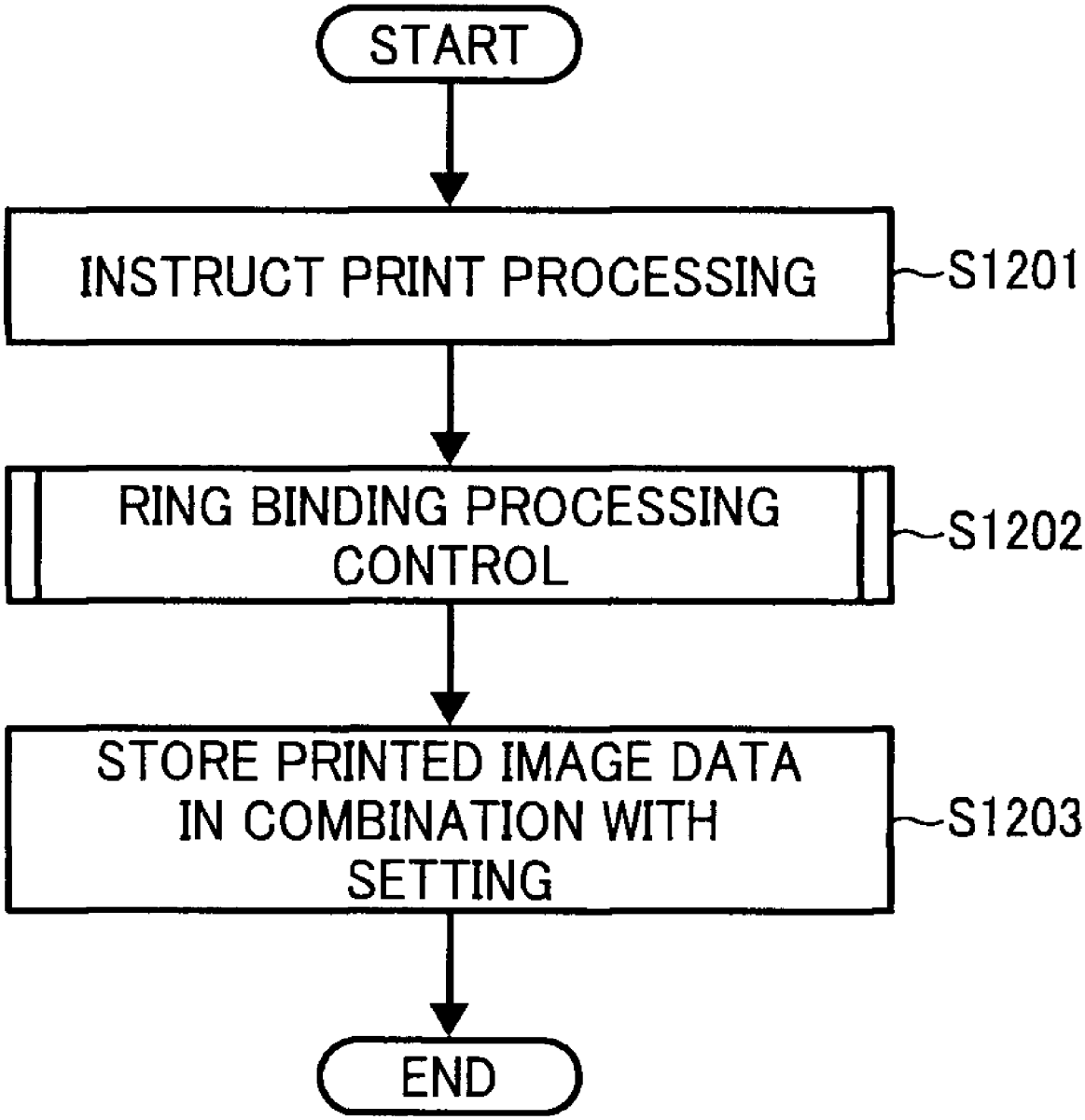
FIG. 10 is a flowchart of an entire process performed by the control device according to the second embodiment in the ring-binding mode.

Steps S906 to S917 shown in FIG. 9 performed by the control device 800 are explained with reference to FIG. 10. Before the process shown in FIG. 10 is performed, the operator sets the ring-binding mode (step S901), and the ring-binding mode is set in the control device 800 via the operation panel 102 (step S902). The operator issues the start instruction to the control device 800 (step S903). The operator operates the operation panel 102 to issue an instruction for reading to the control device 800 (step S904), and the control device 800 instructs the reading device 103 to read original sheets (step S905).

The control device 800 instructs the printing device 104 to perform printing (step S1201). After the printing device 104 prints a set of sheets, the control device 800 controls ring-binding processing (step S1202).

After the ring-binding processing is performed, the control device 800 stores the printed image data in combination with setting (for example, the volume of sheets on which the image data is printed and the size of the ring member with which the sheets of the set are bound) (step S1203).

Figure 11:
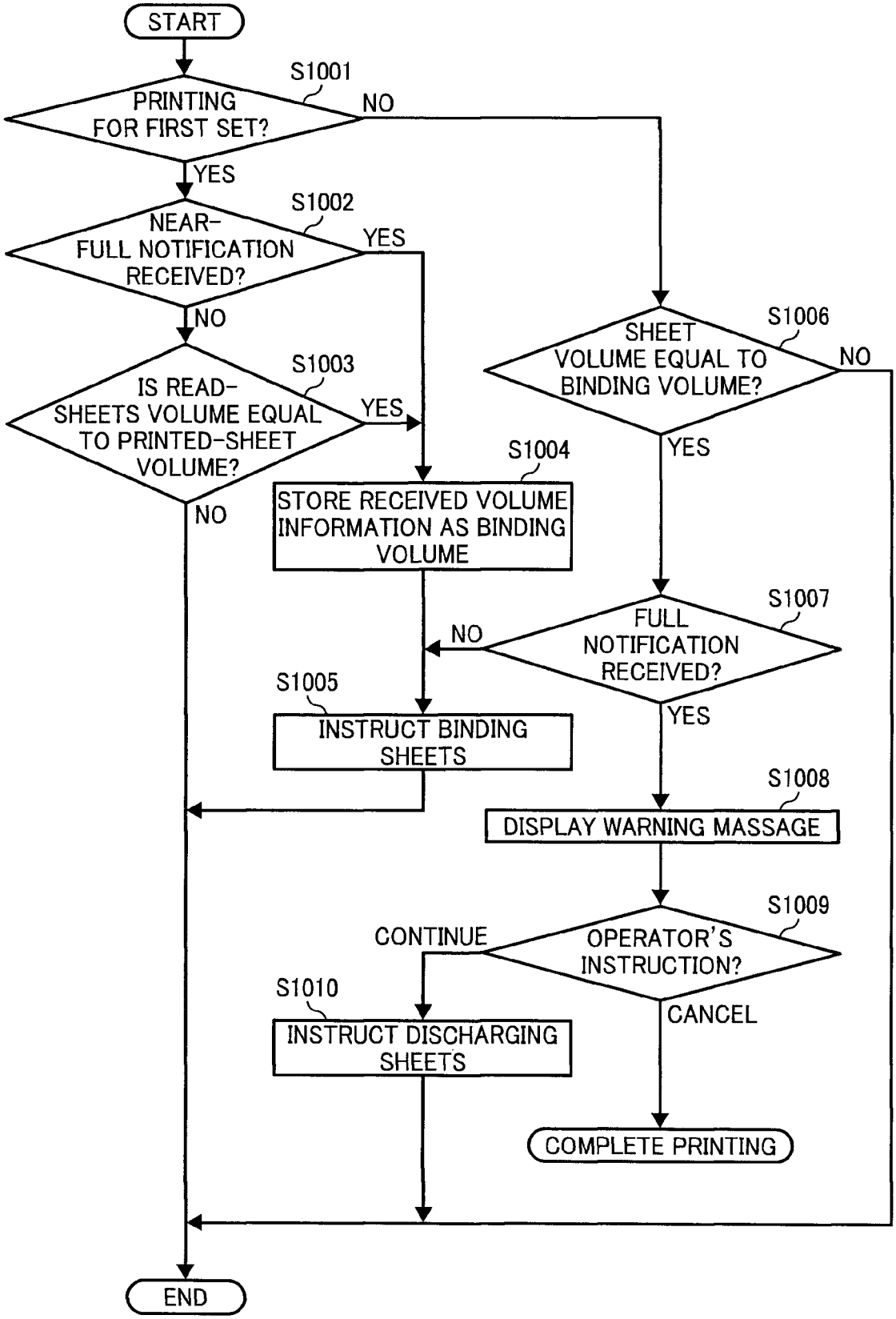
FIG. 11 is a flowchart of a process performed by the control device according to the second embodiment in the ring-binding mode when sheets are bound into a plurality of bundles.
Figure 12:
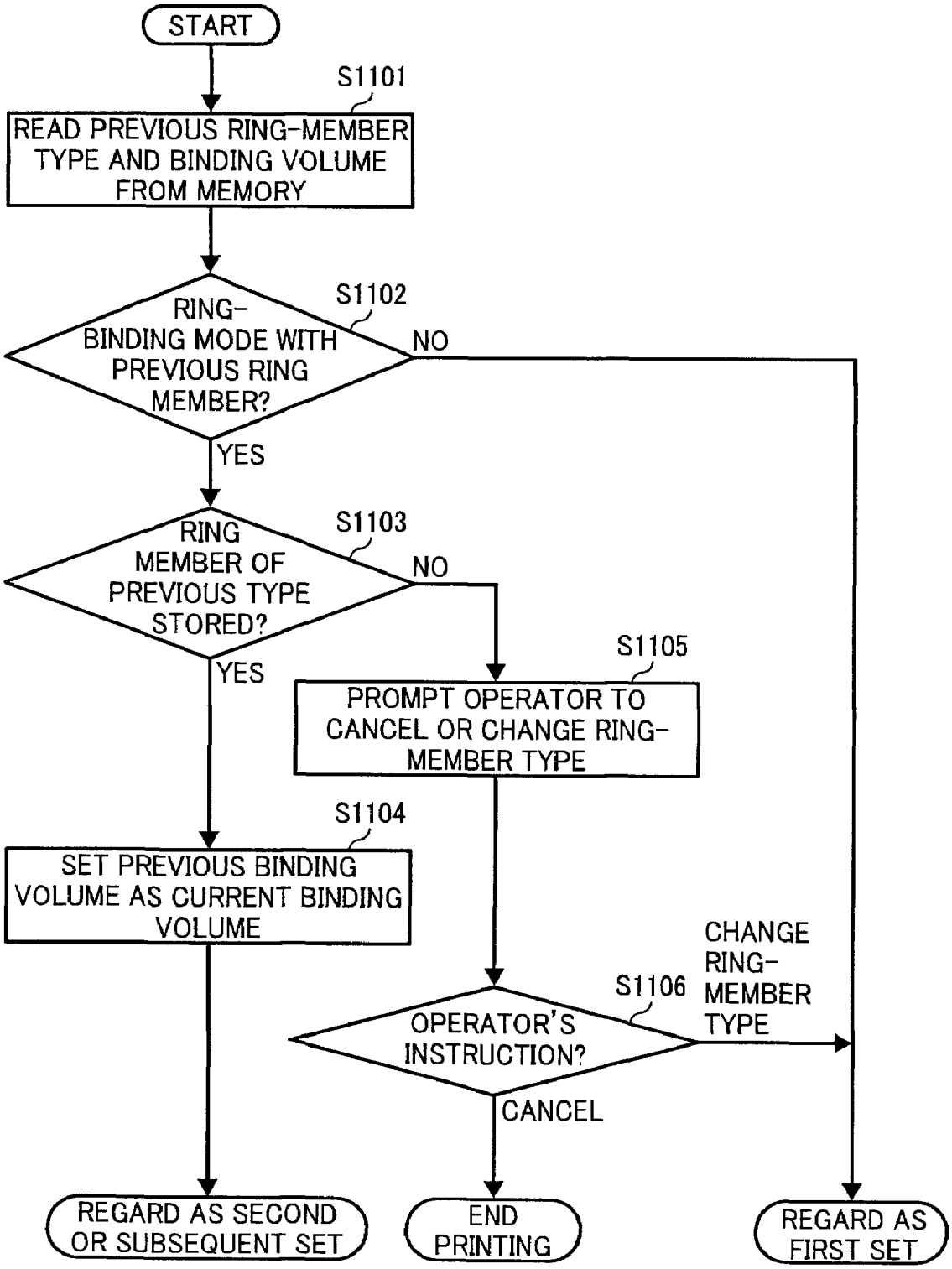
FIG. 12 is a flowchart of a process performed by the control device according to the second embodiment in the ring-binding mode when a document stored in the image forming apparatus is re-printed.

With reference to FIGS. 11 and 12, ring binding process control performed at step S1202 is explained in detail. When the control device 800 is in the best-ring selecting mode and sheets are bound into a plurality of bundles, the control device 800 stores the total thickness (binding volume) and the size of the ring member used to bind the sheets of the first set. Based on the read binding volume and the size, the sheets of the second set are bound. FIG. 11 is a flowchart of a process performed by the control device 800 when the sheets of the second or subsequent set are bound based on the binding volume of the first set. FIG. 12 is a flowchart of a process performed by the control device 800 when the sheets of the second or subsequent set are bound based on the binding volume and the size of the ring member used for the first set of sheets.

The process shown in FIG. 11 starts after the last sheet of each set of sheets is stacked on the adjusting unit 205 and the volume input unit 309 inputs the volume information (step S914).

Once the volume input unit 309 inputs the volume information, the volume determining unit 804 determines whether the sheets stacked on the adjusting unit 205 are of the first or subsequent set based on whether the volume storing unit 802 stores the sheet volume (step S1001).

When the volume determining unit 804 determines that the sheets of the first set of are stacked on the adjusting unit 205, the range determining unit 803 determines whether the thickness input unit has issued the near full notification (step S1002). When the near-full value is not input (No at step S1002), the volume determining unit 804 determines whether the volume represented by the volume information input by the volume input unit 309 is equal to that of the volume of original sheets having read by the reading device 103 (step S1003). In other words, the range determining unit 803 determines whether all of the set of sheets is printed.

When the process control goes No at steps S1002 and S1003, the control device 800 completes the processing and issues the next printing instruction. On the other hand, when the process control goes Yes at step S1002 or step S1003, the volume determining unit 804 stores the volume, which is represented by the input volume information, in the volume storing unit 802 as the binding volume (step S1004). Thereafter, the instructing unit 808 instructs the ring binding device 105 to bind the sheets (step S1005).

When sheets of the second or subsequent set are stacked on the adjusting unit 205 (No at step S1001), the control device 800 performs ring-binding processing for the sheets in a volume equal to that of the first set. For this reason, the volume determining unit 804 determines whether the sheet volume of the second set, which is output from the ring binding device 105, is equal to that of the binding volume of the first set, which is stored in the volume storing unit 802 (step S1006). Only when the volumes are the same (Yes at step S1006), the control device 800 instructs the ring binding device to bind the sheets. Before the control device 800 instructs the ring binding device to bind the sheets, the range determining unit 803 determines whether the full notification is input by the thickness input unit 809 (step S1007). Only when the full value is not input (No at step S1007), the instruction unit 808 instructs the ring binding device 105 to bind the sheets (step S1005). On the other hand, when the full value is input (Yes at step S1007), the display control unit 812 displays the waning message on the operation panel 102 (step S1008) and wait the operator to select the cancellation or the continuation (step S1009). When the operator selects the continuation ("continue" at step S1009), the discharging instructing unit 807 instructs the ring binding device 105 to discharge the sheets to the stacker 207 without binding the sheets (step S1010). When the operator selects the cancellation, ("cancel" at step S1009), the discharging instructing unit 807 instructs the ring binding device 105 to discharge the sheets and instructs the printing device 104 to complete printing (step S1010). In either case, the sheets are not bound. The volumes are not the same at step S1006 or the full value is input at step S1007, when, for example, the sheets of the second set include a sheet that has a thickness larger than those of the sheets of the first set.

In the above explanation, printing is instructed per sheet, in this manner: printing instruction is issued→receive discharging notification→next printing instruction is issued. Alternatively, at the start of the operation, a plurality printing instructions each for printing a sheet can be successively issued, and a next set of printing instructions can be issued when a plurality of sheet-discharging notifications are received, which shorten the printing time and increases printing performance.

The following configuration can be also employed. The ring members in different sizes are stored in the ring-member cartridge 203, and the sizes of the ring members are stored in the size storing unit 801. The size of the ring member is stored in combination with the binding volume at step S1004, and the sheets of the second or subsequent set can be bound with a ring member having the size that of the member used to bind the sheets of the first set.

FIG. 12 is a flowchart of the ring-binding processing performed when the image data stored in a memory (not shown) of the reading device 103, or in the image-data storing unit 811, is re-printed. The case when the image data stored the image-data storing unit 811 is reprinted is explained below.

When the stored image data is reprinted in the ring-binding mode, the same type of the ring member (for example, the 50-sheet ring member or the 100-sheet ring member) as that used to binding the sheets of the previous set is used and the ring binding processing is performed on the sheets in the volume same as the binding volume of the previous set (the setting made in the previous printing is stored in the size storing unit 801). Therefore, after receiving the instruction for printing and before issuing the first printing instruction, the control device 800 performs the process shown in FIG. 11.

The setting unit 810 reads the size of the ring member used for the previous set and the binding volume of the previous set from the image-data storing unit 811 (step S1101). The size and the binding volume are compared with the setting set by the operator and stored in the memory 101*b*, and it is determined whether the ring binding mode is set in which a ring member having the same type as that used for the previous set (step S1102). When a ring member of the same type is used (Yes at step S1102), the ring determining unit 307 determines whether a ring member having the size read at step S1101 is stored in the ring-member cartridge 203 (step S1103).

When a ring member having the read size is stored in the ring-member cartridge 203 (Yes at step S1103), the setting unit 810 stores, in the volume storing unit 802, the binding volume of the previous set as a binding volume of the current set (step S1104). The control device 800 determines that sheets to be printed thereafter are of the second or subsequent set, and the process shown in FIG. 11 is performed.

When it is determined that the ring-binding mode is set in which a ring member having a size different from that of the ring member used for the previous set is to be used (No at step S1102) (including the case when a ring binding mode is not set for the previous set), the volume determining unit 804 determines that the sheets having the total volume represented by the input volume information are of the first set (No at step S1102). When the ring-member cartridge 203 stores therein no ring member having the size of the ring member used for the previous set (No at step S1103), the display control unit 812 displays, on the operation panel 102, a message prompting the operator to select cancellation or changing the type (size) of the ring member (step S1105) and wait the operator to make a selection (step S1106). When the operator selects cancellation ("cancel" at step S1106), the control device 800 completes the print processing on the read image data. On the other hand, when the operator selects to change the size of the ring member ("change ring-member type" at step S1106), the control device 800 regards the sheets on which the read image data is printed thereafter as the first set, and continues performing the process shown in FIG. 11.

As described above, according to the second embodiment, because the binding volume of the first set is stored and the binding volume is set as the binding volume of the second or subsequent set, the uniform volume of sheets can be bound into a bundle.

Furthermore, according to the second embodiment, when the binding volume of the first set is stored and the binding volume is set as the binding volume of the second or subsequent set, it is determined whether the total thickness of sheets of the second or subsequent set is within the allowable range. When the total thickness of the second or subsequent set exceeds the allowable range, the binding the sheets are prevented, which prevents the ring binding device 105 to be damaged.

Moreover, according to the second embodiment, when the total thickness of the sheets stacked in the ring binding device 105 exceed the allowable range, the user can selects whether to cancel or continue printing the second or subsequent set of sheets.

Furthermore, according to the second embodiment, because the size of the ring member used for the first set and the binding volume of the first set are stored in combination, the sheets of the second and subsequent sets can be prevented from being bound with rings having various sizes when ring members having various sizes are used for the first set. Furthermore, the user can select cancel printing or change the size of the ring member and continue printing.

Moreover, according to the second embodiment, the sheet volume of the first set and the size of the ring member used for the first set are stored. The stored sheet volume and the size are employed and the sheets on which the stored image data is re-printed are bound with the stored sheet volume and size. Accordingly, the equal volume of sheets can be bound into a bundle with a ring member having the same size.

As described above, according to an aspect of the present invention, printed sheets can be bound with a member having a size appropriate for a total thickness of the sheets.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A ring-binding control device comprising:

a thickness input unit that inputs thickness information representing a total thickness of sheets stacked on a predetermined stacking unit;

a size storing unit that stores therein a size of a ring member for binding the sheets;

a range determining unit that determines whether the thickness represented by the thickness information is larger than a minimum total thickness of sheets that are allowed to be bound with a ring member having the size stored in the size storing unit and equal to or smaller than a maximum total thickness of sheets that can be bound with the ring member;

a setting unit that sets, when it is determined that the thickness represented by the thickness information is equal to or smaller than the minimum total thickness or larger than the maximum total thickness, the size stored in the size storing unit to a different size; and an instructing unit that issues an instruction for binding the sheets stacked on the stacking unit with a ring member having the size stored in the size storing unit.

2. The ring-binding control device according to claim 1, further comprising a size-change control unit that sets the ring member having the size stored in the size storing unit as a ring member to bind the sheets.

3. The ring-binding control device according to claim 1, wherein when the thickness represented by the thickness information is larger than the maximum total thickness, the setting unit sets the size stored in the size storing unit to a larger size.

4. The ring-binding control device according to claim 1, wherein when the thickness represented by the thickness information is smaller than the minimum total thickness, the setting unit sets the size stored in the size storing unit to a smaller size.

5. The ring-binding control device according to claim 1, further comprising:

a volume input unit that inputs volume information representing a volume of sheets for each set;

a volume storing unit that stores therein a volume of sheets of a first set that is input by the volume input unit; and a volume determining unit that determines whether a volume of sheets of a second or subsequent set that is represented by the volume information reaches the volume of sheets stored in the volume storing unit, wherein when the volume of sheets of the second or subsequent set is equal to the volume of sheets stored in the volume storing unit, the instructing unit issues an instruction for binding the sheets of the second or subsequent set.

6. The ring-binding control device according to claim 5, further comprising a discharging instructing unit that issues, when the thickness of the sheets of the second or subsequent set that is represented by the thickness information is larger than the maximum total thickness, an instruction for discharging the sheets that are stacked on the stacking unit.

7. The ring-binding control device according to claim 5, further comprising:

a suspending unit that suspends, when the thickness of the sheets of the second or subsequent set that is represented by the thickness information is larger than the maximum total thickness, stacking of sheets on the stacking unit; and an instruction receiving unit that receives, after the storing of sheets is suspended, an instruction on whether to continue the stacking of the sheets on the stacking unit.

8. The ring-binding control device according to claim 5, wherein the size storing unit stores a size of a ring member with which the sheets of the first set are bound, and the instructing unit issues an instruction for binding the sheets of the second or subsequent set with a ring member having the size stored in the size storing unit.

9. A method of controlling a ring binding, comprising:

thickness inputting including inputting thickness information representing a total thickness of sheets stacked on a predetermined stacking unit;

size storing including storing a size of a ring member for binding the sheets;

range determining including determining whether the thickness represented by the thickness information is larger than a minimum total thickness of sheets that are allowed to be bound with a ring member having the size stored at the size storing and equal to or smaller than a maximum total thickness of sheets that can be bound with the ring member;

size setting including setting, when it is determined that the thickness represented by the thickness information is equal to or smaller than the minimum total thickness or larger than the maximum total thickness, the size stored at the size storing to a different size; and instruction issuing including issuing an instruction for binding the sheets stacked on the stacking unit with a ring member having the size stored at the size storing.

10. The method according to claim 9, further comprising size changing including setting the ring member having the size stored at the size storing as a ring member to bind the sheets.

11. The method according to claim 9, further comprising:

volume inputting including inputting volume information representing a volume of sheets for each set;

volume storing including storing a volume of sheets of a first set that is input at the volume inputting; and volume determining including determining whether a volume of sheets of a second or subsequent set that is represented by the volume information reaches the volume of sheets stored at the volume storing, wherein when the volume of sheets of the second or subsequent set is equal to the volume of sheets stored at the volume storing, the instruction issuing includes issuing an instruction for binding the sheets of the second or subsequent set.

12. The method according to claim 11, wherein the size storing includes storing a size of a ring member with which the sheets of the first set are bound, and the instruction issuing includes issuing an instruction for binding the sheets of the second or subsequent set with a ring member having the size stored at the size storing.

13. A computer program product comprising a computer-usable medium having computer-readable program codes embodied in the medium that when executed cause a computer to execute:

inputting thickness information representing a total thickness of sheets stacked on a predetermined stacking unit;

storing a size of a ring member for binding the sheets;

determining whether the thickness represented by the thickness information is larger than a minimum total thickness of sheets that are allowed to be bound with a ring member having the size stored at the storing and equal to or smaller than a maximum total thickness of sheets that can be bound with the ring member;

setting, when it is determined that the thickness represented by the thickness information is equal to or smaller than the minimum total thickness or larger than the maximum total thickness, the size stored at the storing to a different size; and issuing an instruction for binding the sheets stacked on the stacking unit with a ring member having the size stored at the storing.

* * * * *